US006065397A

United States Patent [19]

Sato

[11] Patent Number: 6,065,397

[45] Date of Patent: May 23, 2000

[54] PRINTER

[75] Inventor: Mitsuo Sato, Shibata-machi, Japan

[73] Assignee: Tohoku Ricoh Co., Ltd., Shibata-gun, Japan

[21] Appl. No.: 09/135,856

[22] Filed: Aug. 18, 1998

[30] Foreign Application Priority Data

Sep. 12, 1997 [JP] Japan ..... 9-248836
May 29, 1998 [JP] Japan ..... 10-149091

[51] Int. Cl.[7] ..... B41L 13/04

[52] U.S. Cl. ..... 101/118

[58] Field of Search ..... 101/116, 117, 101/118, 114, 246

[56] References Cited

U.S. PATENT DOCUMENTS

| | | | |
|---|---|---|---|
| 4,911,069 | 3/1990 | Hayama et al. . | |
| 5,931,090 | 8/1999 | Ohkawa | 101/118 |
| 5,960,716 | 10/1999 | Schaede | 101/116 |

FOREIGN PATENT DOCUMENTS

| | | |
|---|---|---|
| 61-198065 | 12/1986 | Japan . |
| 4-329175 | 11/1992 | Japan . |
| 5-330225 | 12/1993 | Japan . |
| 7-17121 | 1/1995 | Japan . |
| 8-58216 | 3/1996 | Japan . |
| 8-59031 | 3/1996 | Japan . |
| 8-332769 | 12/1996 | Japan . |
| 9-1914 | 1/1997 | Japan . |
| 9-216448 | 8/1997 | Japan . |
| 11-99735 | 4/1999 | Japan . |

*Primary Examiner*—Ren Yan
*Attorney, Agent, or Firm*—Oblon, Spivak, McClelland, Maier & Neustadt, P.C.

[57] ABSTRACT

A stencil printer capable of conveying a paper by clamping the leading edge portion of the paper and printing an image on the paper is disclosed. Even when an envelope or similar relatively thick paper is used, the printer protects a master wrapped around an ink drum from ripping which would bring about various troubles including the contamination of printings due to ink.

12 Claims, 18 Drawing Sheets

PRINTER

BACKGROUND OF THE INVENTION

The present invention relates to a printer and, more particularly, to a stencil printer of the type pressing a paper with a press drum or an ink drum around which a master is wrapped for thereby printing an image on the paper.

It is a common practice with a stencil printer, which is a specific form of a printer, to use a press roller as pressing means or print pressure device. Another conventional print pressure device uses a press drum for printing an image while forcibly peeling off the leading edge portion of a paper from an ink drum. The press drum has substantially the same outside diameter as the ink drum and is rotated at substantially the same peripheral speed as, but in the opposite direction to, the ink drum while clamping the leading edge portion of a paper. With the press drum, it is possible to prevent the leading edge of a paper from remaining on the ink drum without being removed by a peeler and thereby jamming a paper transport path. Further, the press drum reduces noise and enhances the registration accuracy of an image in the direction of paper conveyance. In the print pressure device using the press drum, a paper clamper is positioned in a recess formed in a part of the outer periphery of the press drum and clamps the leading edge portion of a paper fed to the press drum. The press drum presses the paper against the ink drum with the paper clamper clamping the paper, so that an image is printed on the paper. Subsequently, the paper clamper is opened in order to release the paper or printing. The printer is transferred from the paper clamper to a paper conveying unit.

The above paper clamper clamps the leading edge portion of a paper over several millimeters, generally 2 mm to 5 mm. At this instant, the paper clamper slightly bends the leading edge portion of the paper inward in the radial direction of the press drum, so that the clamper itself does not contact the ink drum. This kind of layout works satisfactorily so long as the paper to be clamped is an ordinary paper or similar thin paper. However, when the paper is a drawing paper, postcard or similar thick paper, the paper clamper cannot bend the leading edge portion of the paper radially inward unless it is sufficiently strong. As a result, the end of the paper clamper cannot be fully closed and hits against the master wrapped around the ink drum, ripping the master. Consequently, ink fed to the outer periphery of the ink drum is forced out via the ripped portion of the master and transferred to the paper clamper. This part of the ink smears the paper clamper and therefore the leading edge portion of the paper.

Technologies relating to the present invention are also disclosed in, e.g., Japanese Utility Model Laid-Open Publication No. 61-198065, Japanese Patent Laid-Open Publication Nos. 7-17121, 4-329175, 8-59031, 5-330225, 8-332769, 9-1914, 9-216448 and 8-58216, and U.S. Pat. No. 4,911,069.

SUMMARY OF THE INVENTION

It is therefore an object of the present invention to provide a printer capable preventing, even when an envelope or similar relatively thick paper is used, protecting a master wrapped around an ink drum from ripping which would bring about various troubles including the contamination of a printing due to ink, without resorting to any modification of the basic arrangement around a press drum.

In accordance with the present invention, a printer includes an ink drum for wrapping a master on its outer periphery and a press drum substantially identical in outside diameter with the ink drum and having a paper clamper for clamping the leading edge portion of a paper fed thereto. The press drum is pressed relatively against the ink drum for printing an image on the paper. A registration roller feeds the leading edge of the paper toward the paper clamper. A control unit causes, when the paper is a particular kind of paper, the leading edge of the paper to be fed to a position where the leading edge will not be clamped by the paper clamper.

Also, in accordance with the present invention, a printer includes an ink drum for wrapping a master on its outer periphery and a press drum substantially identical in outside diameter with the ink drum and having a paper clamper for clamping the leading edge portion of a paper fed thereto. The press drum is pressed relatively against the ink drum for printing an image on the paper. A drive device causes the paper clamepr operate. A registration roller feeds the leading edge of the paper toward the paper clamper. A control unit controls, when the paper is a particular kind of paper, the drive device such that the paper clamper does not clamp the leading edge portion of the particular kind of paper.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
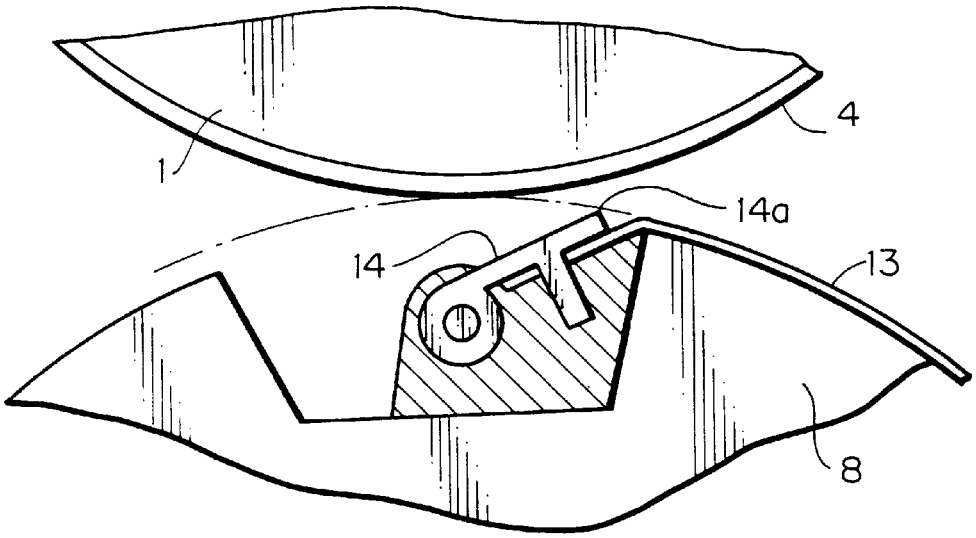
Fig. 1 PRIOR ART
FIG. 1 is a section showing a condition wherein an ordinary paper (plain paper) is clamped by a paper clamper mounted on the press drum of a conventional stencil printer.

To better understand the present invention, brief reference will be made to a conventional stencil printer which is a specific form of a printer. The stencil printer to be described is of the type including an ink drum and a press drum. A paper clamper is arranged in a recess formed in a part of the outer periphery of the press drum. The press drum is pressed against the ink drum with the paper clamper clamping the leading edge portion of a paper or similar recording medium. As a result, ink is transferred from the ink drum to the paper and prints an image thereon. Subsequently, the paper clamper is opened to release the paper or printing. The printing is driven out of the printer by a paper conveying unit. Specifically, as shown in FIG. 1, a paper clamper 14 clamps the leading edge portion of a paper 13 with its end 14*a* over several millimeters, generally 2 mm to 5 mm. At this instant, the paper clamper 14 slightly bends the leading edge portion of the paper 13 inward in the radial direction of the press drum 8, so that the clamper 14 itself does not contact an ink drum 1. In FIG. 1, the reference numeral 4 designates a master wrapped around the ink drum 1.

The above paper clamper 14 works satisfactorily so long as the paper 13 to be clamped thereby is a plain paper or similar thin paper. In practice, however, the stencil printer deals with various kinds of papers including drawing papers, thick papers, postcards, and envelopes. This brings about the following problems.

Figure 2:
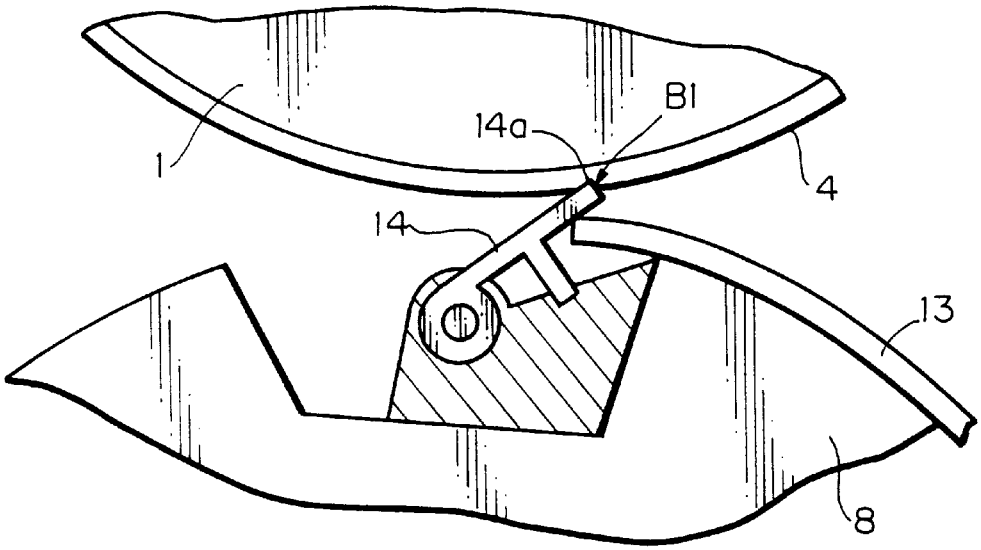
Fig. 2 PRIOR ART
FIG. 2 is a view similar to FIG. 1, showing a condition wherein a thick paper is clamped by the paper clamper.

Assume that the paper 13 is a drawing paper, postcard or similar thick paper. Then, the paper clamper 14 cannot bend the leading edge portion of the paper 13 radially inward, as shown in FIG. 1, unless it is sufficiently strong. As a result, as shown in FIG. 2, the end 14*a* of the paper clamper 14 cannot be fully closed and hits against the master 4 wrapped around the ink drum 1. The end 14*a* hits against the same portion B1 of the master 4 every time the press drum 8 is rotated, ripping the portion B1 of the master 4. Consequently, ink fed to the outer periphery of the ink drum 1 is forced out via the ripped portion B1 of the master 4 and transferred to the paper clamper 14. This part of the ink smears the paper clamper 14 and therefore the leading edge portion of the paper 13.

Figure 3:
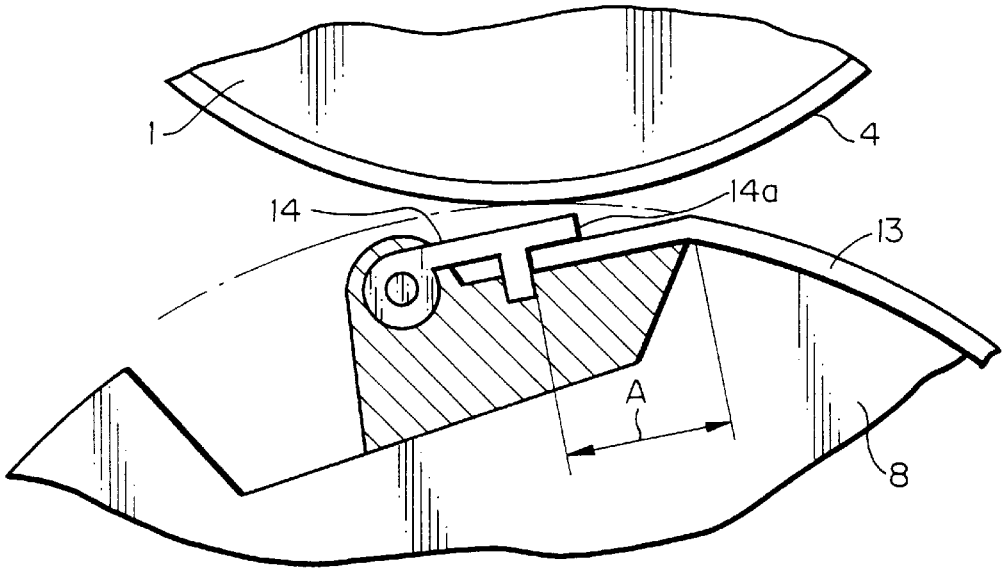
Fig. 3 PRIOR ART
FIG. 3 is a view similar to FIG. 2, demonstrating a problem particular to the condition of FIG. 1 from another standpoint.

The master 4 with the ripped portion B1 is pulled to the upstream side in the direction of rotation of the ink drum 1 at each time of printing. It is therefore likely that the master 4 is torn off at the portion B1 and shifted to the upstream side. FIG. 3 shows a simple implementation for allowing the end 14*a* of the paper clamper 14 to surely clamp even a thick paper without contacting the master 4. As shown, the end 14*a* is shifted to the downstream side in the direction of rotation of the press drum 8. Alternatively, the entire paper clamper 14 including the end 14*a* may be increased in strength.

Figure 4:
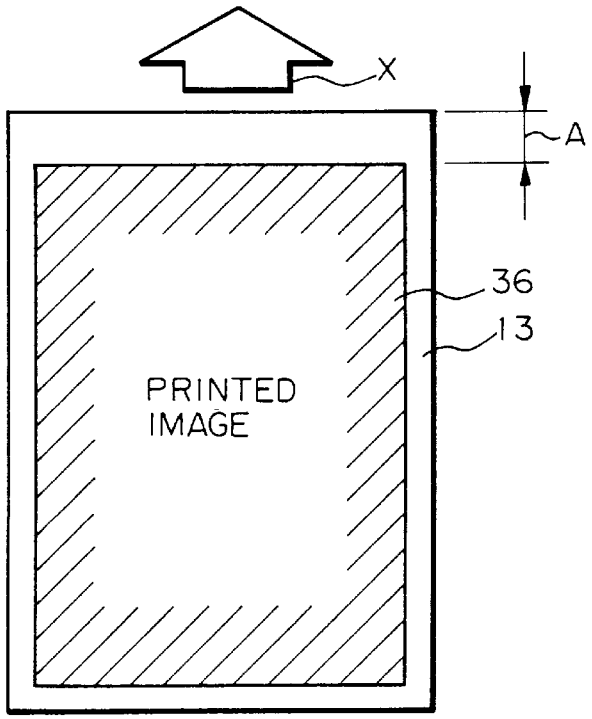
Fig. 4 PRIOR ART
FIG. 4 is a plan view showing the position of an image printed on a thick paper by the conventional stencil printer.

FIG. 4 shows the paper 13 including an image area 36 indicated by hatching and a non-image area or margin positioned at the leading edge portion of the paper 13 in a direction X in which the paper 13 is conveyed. The problem with the arrangement shown in FIG. 3 is that the margin between the leading edge of the paper 13 and that of the image area 36 increases. In FIGS. 3 and 4, the margin A is shown as having a length A. On the other hand, increasing the strength of the entire paper clamper 14 complicates the structure and increases the cost of the clamper 14. In addition, such a strong paper clamper 14 would form a fold in the leading edge portion of the thick paper 13.

Preferred embodiments of the printer in accordance with the present invention will be described hereinafter. In the illustrative embodiments, structural elements identical in function and configuration are designated by identical reference numerals and will not be repeatedly described in order to avoid redundancy. As for structural elements provided in pairs, but not needing distinction, only one of them will be shown in the drawings for simplicity.

1st Embodiment

Referring to FIG. 1, a stencil printer embodying the present invention is shown and implemented as a stencil printer by way of example. As shown, the stencil printer includes a hollow cylindrical ink drum 1 for wrapping a perforated stencil or master 4 therearound. An ink feeding device 5A is arranged within the ink drum 1 for feeding ink to the master 4. A master discharging section 38 is located at the left-hand side of the ink drum 1 for peeling off a used master from the outer periphery of the ink drum 1 and discharging it. A master making section 37 is positioned at the right-hand side of the ink drum 1 for making a master and feeding it. A press drum 8 is positioned below the ink drum 1 for pressing a paper 13 relatively against the outer periphery of the ink drum 1. A paper clamper or clamping means 14 is mounted on the press drum 8 in order to clamp the leading edge portion of the paper 13 fed thereto. A paper feeding section 39 is located at the right-hand side of the press drum 8 for feeding papers 13 to the paper clamper 14 one by one. A paper discharging section 22 is arranged at the left-hand side of the press drum 8. An operation panel 90 (see FIG. 8) is positioned above the ink drum 1 so as to allow the operator to manipulate the printer.

Figure 5:
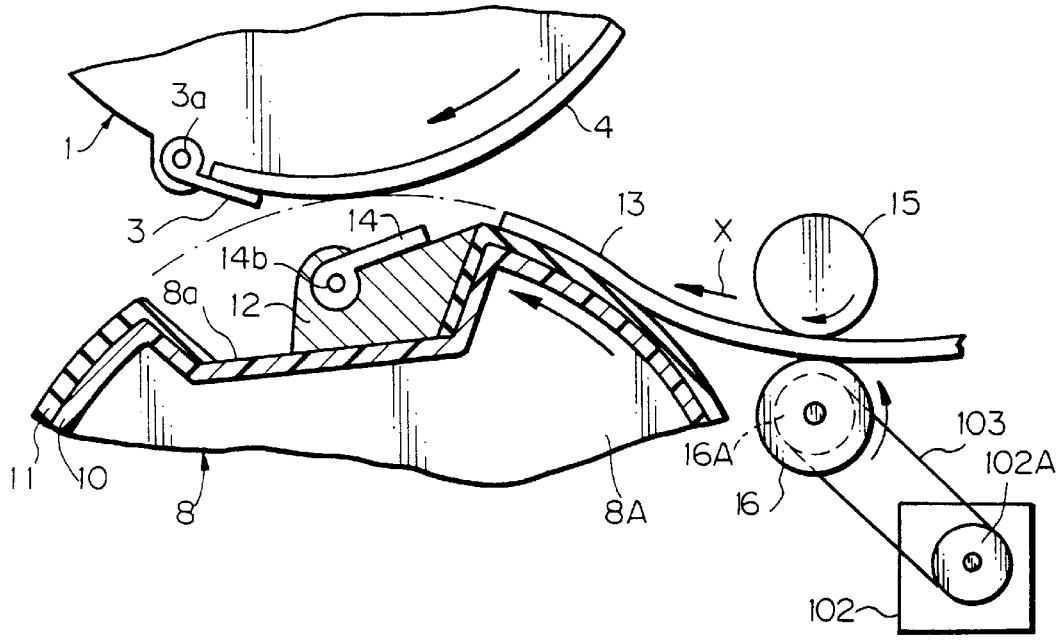
FIG. 5 is partly sectional front view showing a first embodiment of the stencil printer in accordance with the present invention in a condition implementing a thick paper mode.
Figure 6:
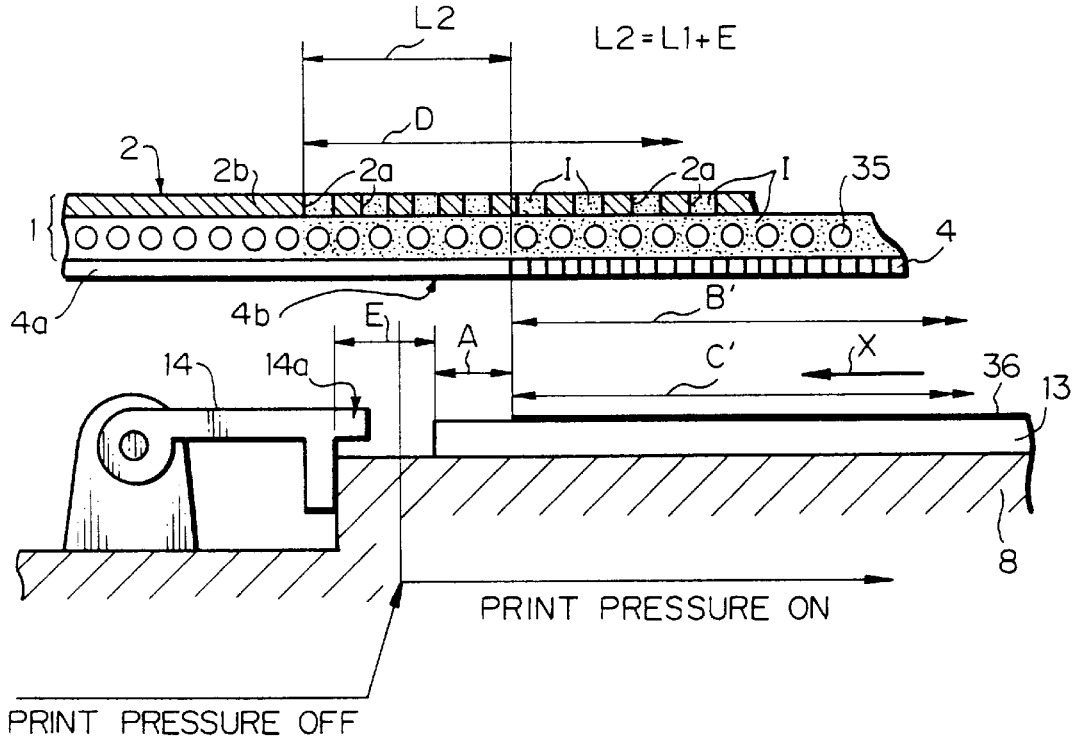
FIG. 6 is a sectional front view showing a positional relation between a hollow cylindrical base, a screen layer and a master, a press drum, a paper clamper, a paper and print pressure ON/OFF occurring in the thick paper mode in the first embodiment.
Figure 7:
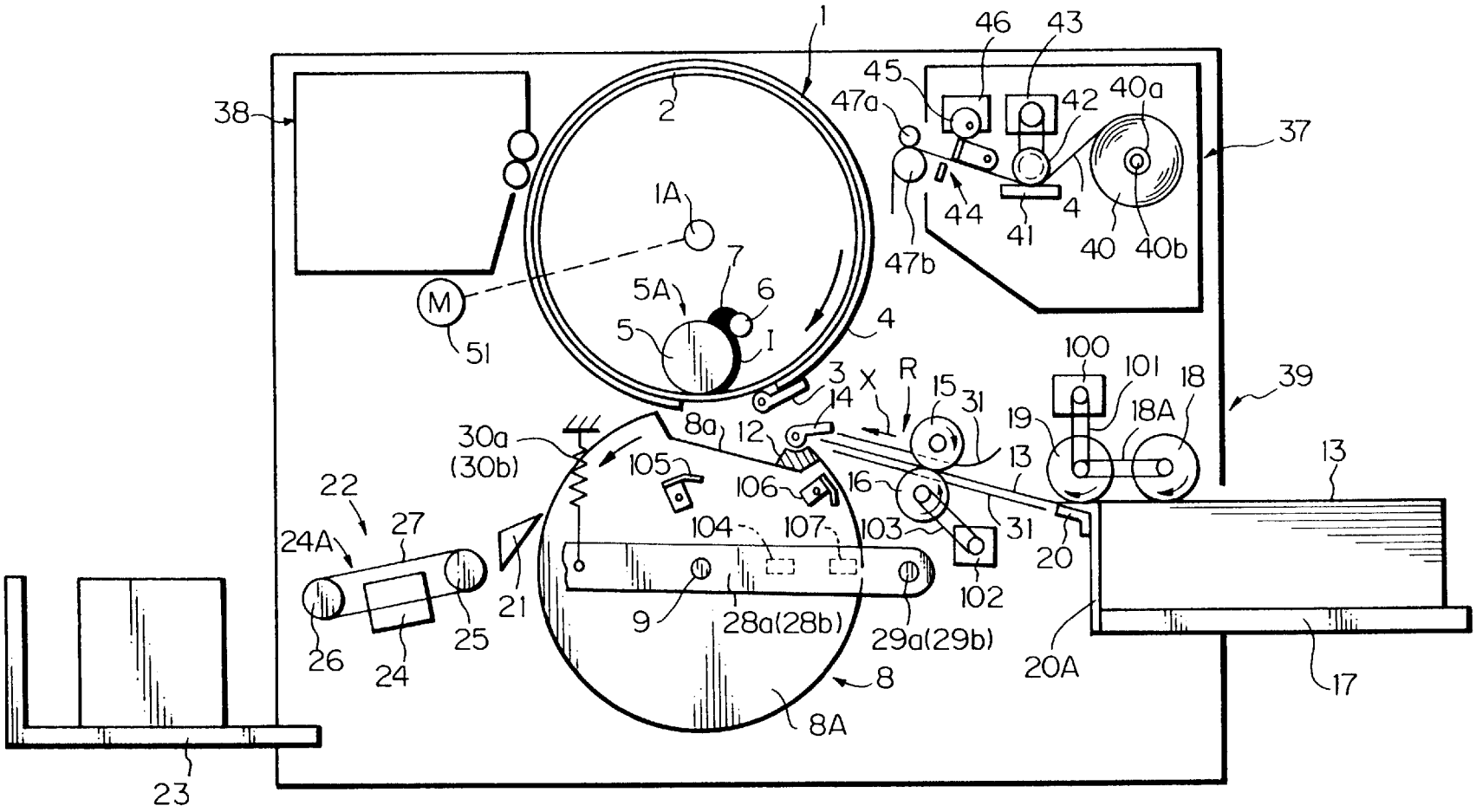
FIG. 7 is a front view showing the general construction of a stencil printer to which the first embodiment as well as other embodiments are applied.
Figure 10:
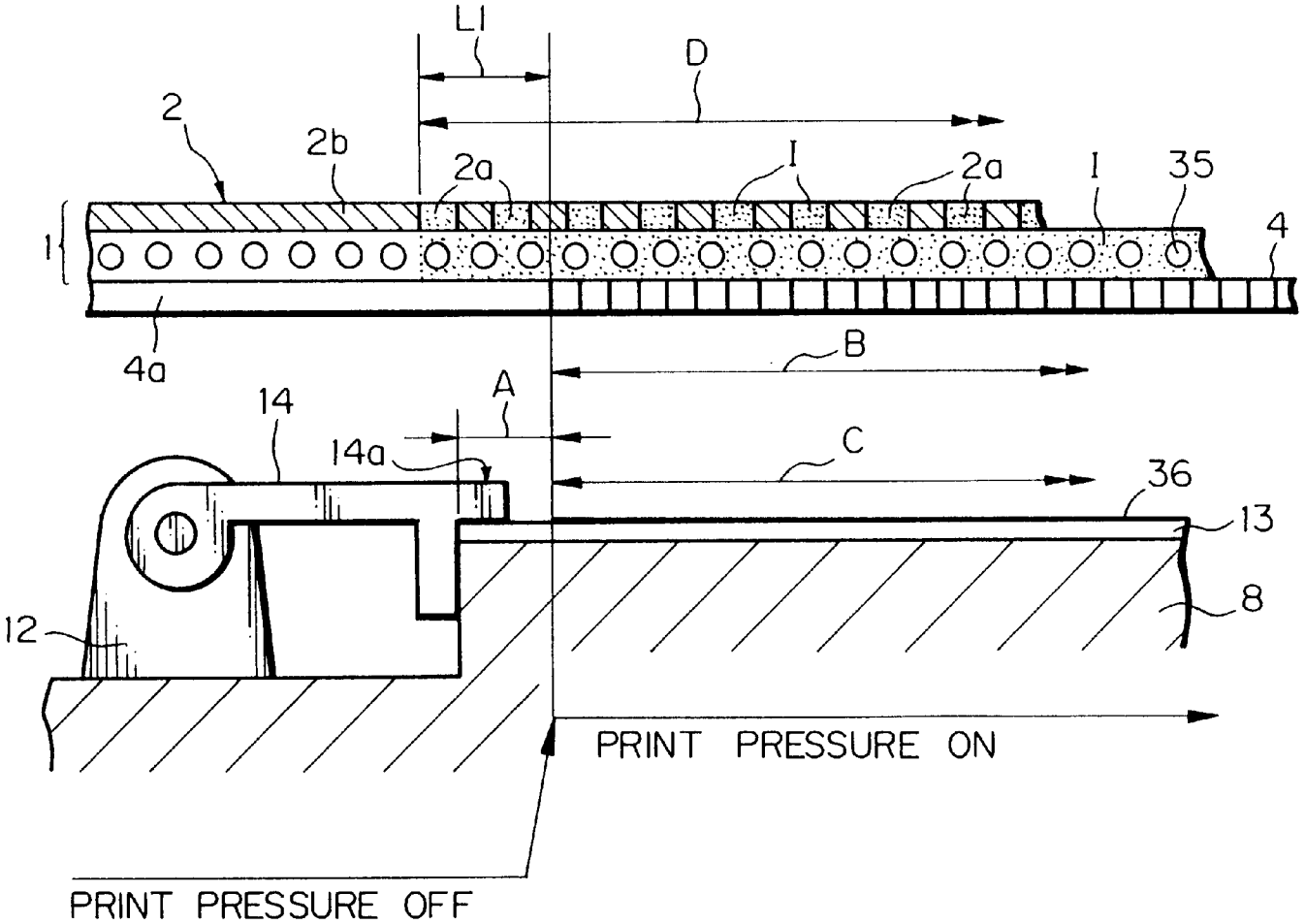
FIG. 10 is a sectional front view showing a positional relation between the hollow cylindrical base, screen layer and master, the press drum, the paper clamper, the paper and the print pressure ON/OFF occurring in a plain paper mode in the printer of FIG. 7.

As shown in FIGS. 6 and 10, the ink drum 1 includes a hollow cylindrical base 2 and a laminate of mesh screen layers (simply screen layer hereinafter) 35 wrapped around the base 2. The base 2 has a porous area D formed with a number of pores 2*a* for allowing ink I to pass therethrough, and a non-porous area 2*b*. The print drum 1 is affixed to opposite end walls rotatably mounted on a center shaft 1A, FIG. 7. A main motor 51, FIG. 7, is included in a drive mechanism for rotating the ink drum 1 in a direction indicated by an arrow in FIGS. 5 and 7, as will be described specifically later. The main motor 51 is implemented by, e.g., a DC motor. The main motor 51 is smaller in size than the conventional main motor because its output torque does not have to be transferred to a paper feed driveline, as will also be described specifically later.

Figure 22:
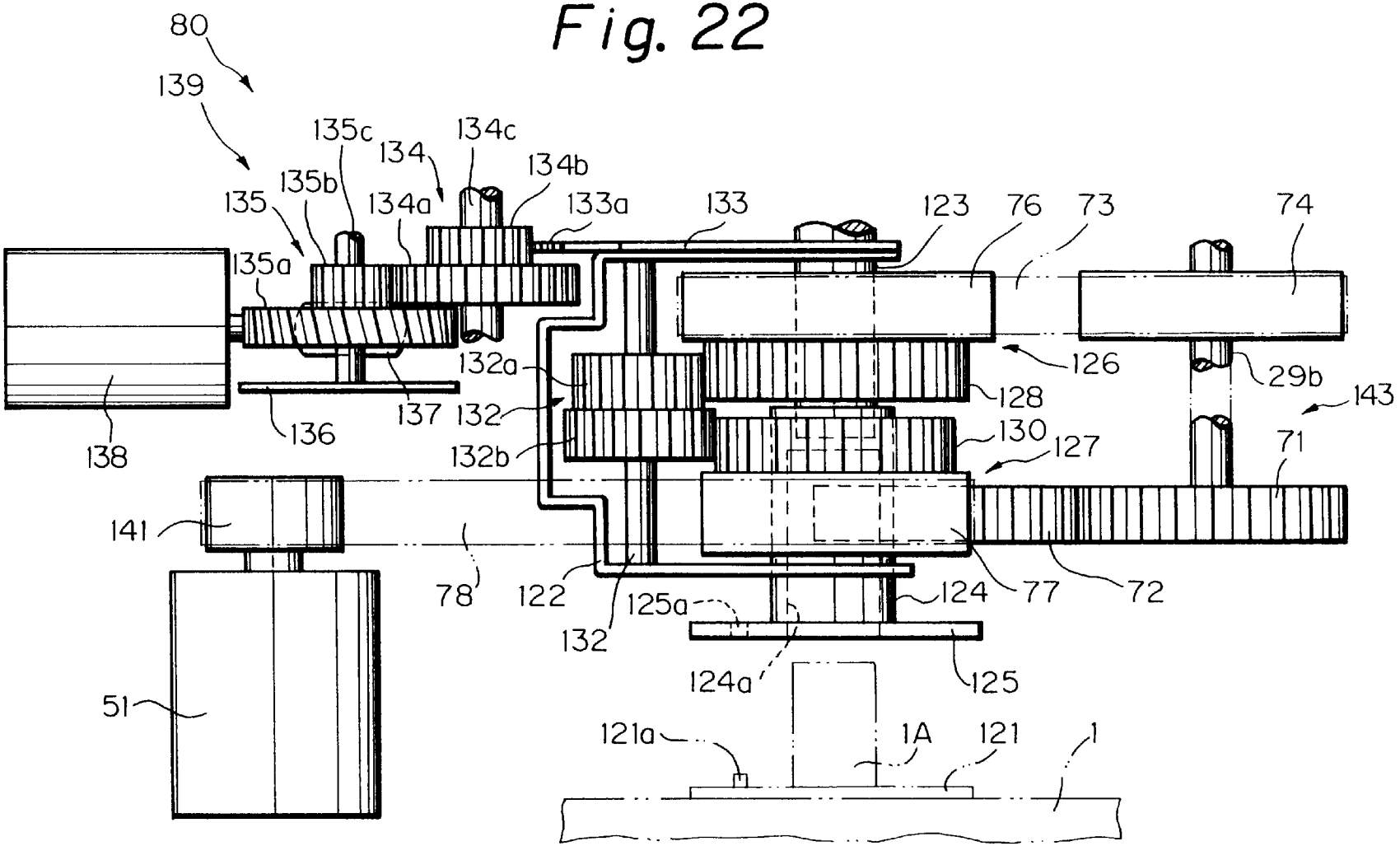
FIG. 22 is a plan view also showing the drive mechanism and top-bottom shifting device.

As shown in FIG. 22, one end or rear end of the center shaft 1A protrudes from the adjoining end wall of the ink drum 1 and is removably connected to the drive mechanism which will be described. A disk 121 is affixed to the outside of the rear end wall of the ink drum 1. A lug 121*a* is provided on the disk 121 and engageable with the drive mechanism. As shown in FIGS. 5 and 7, a master clamper 3 is mounted on the outer periphery of the ink drum 1 for clamping the leading edge portion of the stencil or master 4 perforated by the master making section 37. The non-porous area 2*b* covers the portion where the master clamper 3 is located, the portion around the master clamper 3, and the opposite side edge portions of the base 2. The master clamper 3 faces a stage, not shown, mounted on the ink drum 1 and formed of a ferromagentic material. The stage extends in the axial direction of the ink drum 1. The master clamper 3 is rotatable about a shaft 3*a*. A magnet is adhered to the surface of the master clamper 3 facing the stage. When the print drum 1 reaches a preselected angular position, the master clamper 3 is caused to open and then close by a solenoid, not shown, included in an opening and closing device, not shown.

As shown in FIG. 7, the ink feeding device 5A includes an ink roller 5 rotatable in synchronism with and in the same direction as the ink drum 1 for feeding the ink I to the inner periphery of the drum 1. A doctor roller 6 extends in parallel to the ink roller 5 and is spaced from the roller 5 by a small gap, forming an ink well 7. The ink I is fed to the ink well 7 via the center shaft 1 A. The ink roller 5 and doctor roller 6 are rotatably supported by side walls affixed to the center shaft 1A. Because the inner periphery of the ink drum 1 and the outer periphery of the ink roller 5 are spaced by a small gap, the ink I fed from the ink well 7 to the outer periphery of the ink roller 5 is delivered to the inner periphery of the print drum 1. The ink I is fed under pressure from an ink pack to the center shaft 1*a* by an ink pump, although not shown specifically. Then, the ink I is fed to the ink well 7 via holes formed in the center shaft 1A.

As shown in FIG. 7, the master making section 37 includes a stencil roll 40 made up of a core 40*a* and a stencil, also labeled 4, wound around the core 40*a*. The stencil roll 40 is supported by a shaft 40*b* such that the stencil 4 can be paid out from the roll 40, as needed. A platen roller 4 conveys the stencil 4 paid out from the roll 40. A thermal head or master making means 41 is movable into and out of contact with the platen roller 42 for perforating, or cutting, the stencil 4. An upper and a lower cutter member 44 are positioned downstream of the platen roller 42 in the direction of stencil conveyance. The cutters 44 cooperate to cut away the perforated part of the stencil 4. A pair of feed rollers 47*a* and 47*b* drive the leading edge of the cut stencil or master 4 toward the master clamper 3.

The platen roller 42 has its shaft rotatably supported. A pulse motor 43 causes the platen roller 42 to rotate at a preselected peripheral speed so as to convey the stencil 4 while pressing it against the thermal head 41. A number of heating elements are arranged on the thermal head 41 in an array extending in the widthwise direction of the stencil 4. The head 41 is selectively moved into or out of contact with the platen roller 42 by a conventional mechanism not shown. The head 41 perforates the stencil 4 by heat in accordance with a digital image signal processed by an analog-to-digital (A/D) converting section included in a scanner, not shown, and a master making control section not shown, thereby forming an image in the stencil 41 in the form of perforations. The upper cutter member 44 is moved up and down by an eccentric cam 45 rotated by a cutter motor 46 in order to cut off the stencil 4.

Figure 9:
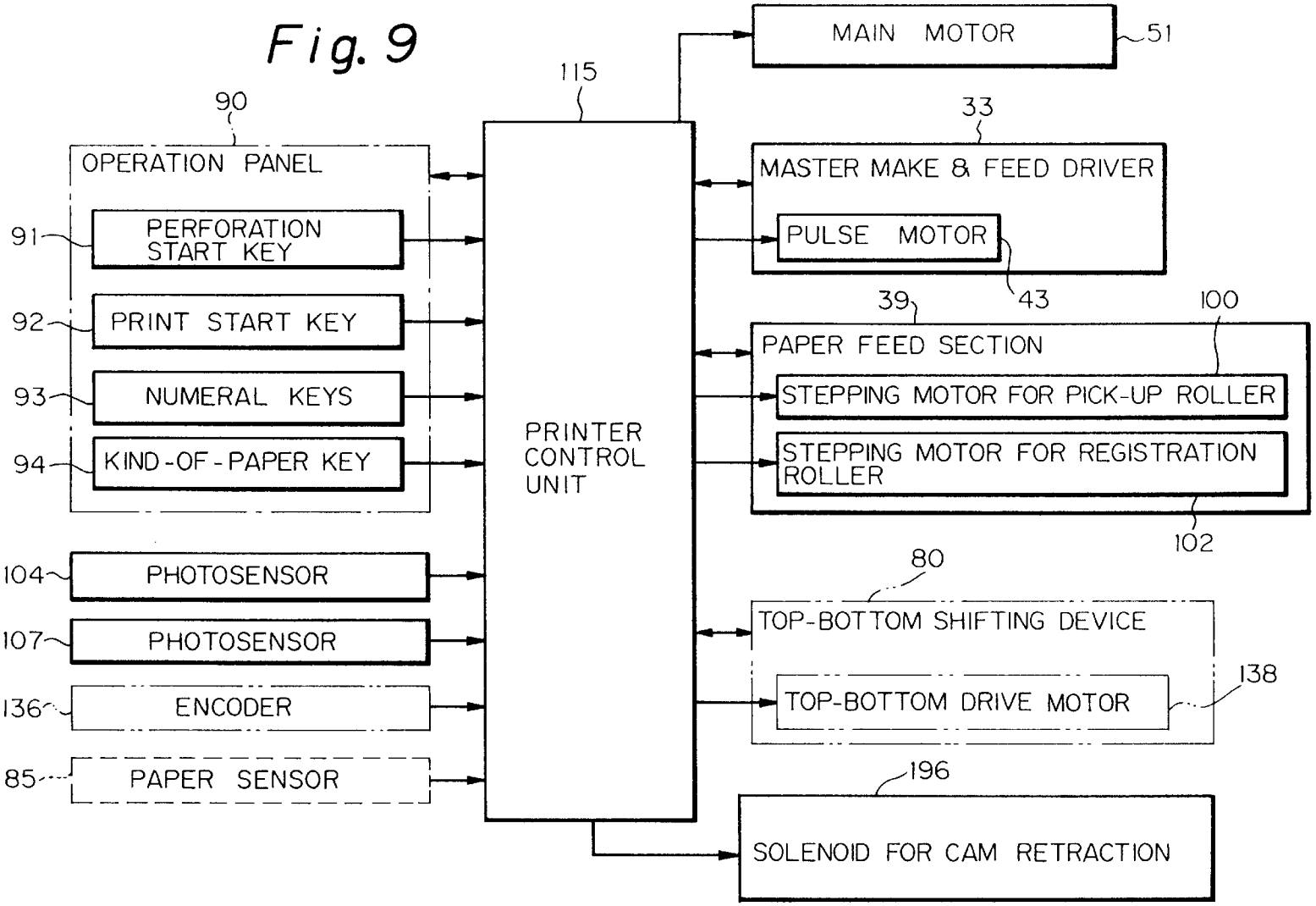
FIG. 9 is a block diagram schematically showing a control system also included in the printer of FIG. 7.

The platen roller 42, pulse motor 43, feed rollers 47*a* and 47*b*, master clamper 3 and solenoid, not shown, constitute master feeding means for feeding the perforated stencil or master 4 and wrapping it around the ink drum 1. In FIG. 9, the thermal head 41 and the above drive members to be controlled and included in the master feeding means are collectively represented by a master make and feed driver 33; only the pulse motor 43 is shown in the block 33 as a representative.

The press drum 8 with the paper clamper 14 plays the role of pressing means for enhancing accurate registration of the paper 13, as in the conventional construction. As shown in FIG. 7, the press drum 8 is positioned below the ink drum 1 and rotated by a drive mechanism, which will be described, together with a shaft 9 counterclockwise, as indicated by an arrow in FIGS. 5 and 7. The press drum 8 has substantially the same outside diameter as the ink drum 1.

To better understand this embodiment and a second embodiment to follow, FIGS. 6, 10, 17 and 18 each shows, as needed, the relation between the base 2 of the ink drum 1, screen layers 35 and master 4, the press drum 8, the paper clamper 14, the paper 13 and print ON/OFF in a developed view. FIG. 6 shows a condition wherein the paper 13 is implemented by a plain paper.

As shown in FIG. 5, the press drum 8 is made up of a substantially cylindrical hollow base 10 formed of synthetic resin, and a rubber layer 11 covering the base 10 and capable of contacting the outer periphery of the ink drum 1. A recess 8*a* having a generally D-shaped cross-section is formed in the outer periphery of the press drum 8 in order to prevent the press drum 8 from interfering with the master clamper 3 mounted on the ink drum 1. A clamper base 12 is positioned in the recess 8*a*. The paper clamper 14 is openably mounted on the press drum 8 via the the clamper base 12 and a clamper shaft 14*b*. The paper clamper 14 is affixed to the clamper shaft 14*b* at one end and constantly biased in its closing direction by a spring not shown. The paper clamper 14 is caused to open at a preselected timing, catch the leading edge of the paper 13, and then close by a cam not shown. As a result, the paper 13 is retained on the outer periphery of the press drum 8.

The above cam for actuating the paper clamper 14 is located at a preselected position on the printer body. The cam is brought into contact with a cam follower, not shown, at a preselected timing in order to cause the paper clamper 14 to open and close. The cam follower is rotatably mounted on the end of an arm, not shown, mounted on the clamper shaft 14*b*. If desired, the cam and cam follower may be included in drive means 180 (see FIGS. 25 and 26) which will be described in relation to a fourth embodiment.

The press drum 8 has the same outside diameter as the ink drum 1. Therefore, the press drum 8 completes one rotation at the same time as the ink drum 1 completes one rotation, causing the recess 8*a* to face the master clamper 3. As shown in FIGS. 5 and 7, such a relation between the press drum 8 and the ink drum 1 makes it possible to mount the paper clamper 14 on the press drum 8. By causing the paper 13 to be fed with its leading edge abutting against the paper clamper 17, it is possible to enhance accurate registration of the paper 13.

At the angular position of the press drum 8 shown in FIG. 7 (sometimes referred to as a paper clamp position hereinafter), the leading edge of the paper 13 abuts against the paper clamper 14. Then, the paper clamper 14 is closed to clamp the leading edge portion of the paper 13. Subsequently, the position of the paper clamper 14 sequentially varies due to the counterclockwise rotation of the press drum 8. As soon as the paper clamper 14 reaches a position just short of a peeler 21 which will be described (sometimes referred to as a paper discharge position hereinafter), the clamper 14 is opened. As a result, the leading edge portion of the paper 13 is released at a position past of a pressing position where the ink I is transferred to the paper 13. This successfully prevents the paper 13 from wrapping around the ink drum 1 due to the adhering force of the ink I.

Figure 19:
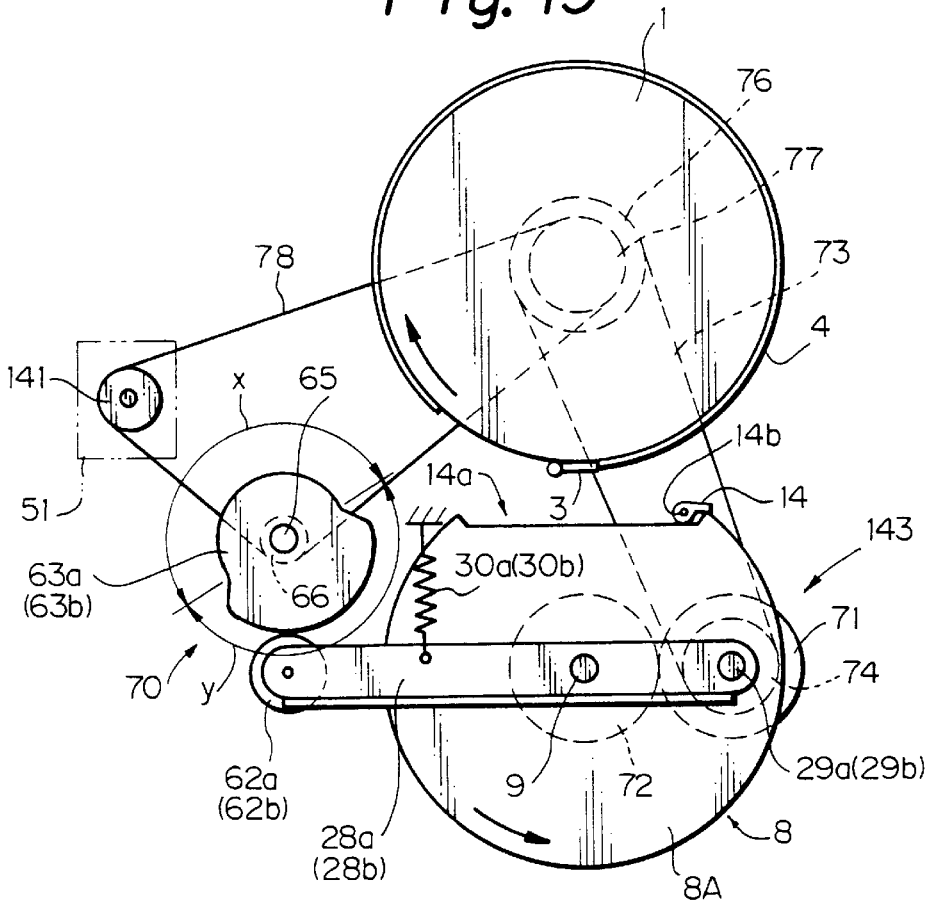
FIG. 19 is a front view showing means for moving the press drum.

As shown in FIG. 19, a moving device or moving means 70 selectively moves the press drum 8 into or out of contact with the outer periphery of the ink drum 1. The moving device 70 includes a pair of arms 28*a* and 28*b* respectively rotatably supporting shafts 9 affixed to the opposite ends of the press drum 8. The arms 28*a* and 28*b* are angularly movable about shafts or fulcrums 29*a* and 29*b*, respectively. A pair of cam followers 62*a* and 62*b* are respectively rotatably supported by the other ends of the arms 28*a* and 28*b*. A pair of springs 30*a* and 30*b* are respectively anchored to the arms 28*a* and 28*b* in order to constantly bias the press drum 8 toward the ink drum 1. A pair of cams 63*a* and 63*b* selectively contact the cam followers 62*a* and 62*b*, respectively.

While the illustrative embodiment uses a system pressing the press drum 8 against the ink drum 1, there are also known a system pressing an ink drum against a press drum or a system pressing both of an ink drum and a press drum against each other.

As shown in FIG. 19, the cams 63*a* and 63*b* each is connected to the ink drum 1 and main motor 51, FIG. 7, by a toothed belt 78 and therefore rotatable in synchronism with the ink drum 1. The cams 63*a* and 63*b* each has a profile made up of a larger diameter portion and a smaller diameter portion, as illustrated. When the conveyance of the paper 13 fails or during master making operation, the larger diameter portion slidingly contacts the associated cam follower 62*a* or 62*b* in order to release the press drum 8 from the ink drum 1. When defective paper conveyance or similar error does not occur, the smaller diameter portion prevents the cam 63*a* or 63*b* from contacting the associated cam follower 62*a* or 62*b* in order to cause the press drum 8 retaining the paper 13 thereon to be pressed against the ink drum 1 due to the action of the springs 30*a* and 30*b*. In this configuration, the cams 63*a* and 63*b* control the timing for the press drum 8 to be pressed against the ink drum 1. In this manner, the press drum 8 is movable about the shafts 29*a* and 29*b* between a position where it is pressed against the ink drum 1 and a position where it is spaced from the ink drum 1 in accordance with the rotation of the cams 63*a* and 63*b*, thereby effecting print ON/OFF operation.

The springs 30*a* and 30*b* generate a force for urging the press drum 8 against the ink drum 1. The springs 30*a* and 30*b* are respectively anchored to the arms 28*a* and 28*b* in order to render the pressing force of the press drum 8 acting on the ink drum 1 uniform.

When defective paper conveyance, for example, occurs, a pressure cancelling device, not shown, cancels the pressure acting on the press drum 8 in order to prevent the press drum 8 from being pressed against the ink drum 1.

The master discharging section 38 peels off the used master 4 from the outer periphery of the ink drum 1 and stores it, as well known in the art.

As shown in FIG. 7, the paper discharging section 22 includes the previously mentioned peeler 21 for peeling off the paper or printing 13 while guiding it. A paper conveying device 24A conveys the printing 13 peeled off and guided by the peeler 21. The paper conveying device 24A is made up of an inlet roller 25, an outlet roller 26, a belt 27 passed over the two rollers 25 and 26, and a suction fan 24 for sucking the rear of the printing 1. A motor, for example, causes the belt 27 to move at a speed higher than the peripheral speed of the ink drum 1. The printing 13 is driven out onto a tray 23 located at the left-hand side of the paper discharging section 22.

The paper feeding device 39 has a unique arrangement, as follows. The paper feeding device 39 includes an elevatable paper tray 17 loaded with a stack of papers 13. A pick-up roller 18 and a separator roller 19 are journalled to opposite side walls not shown. A separator pad 20 is pressed against the separator roller 19 in order to prevent two or more papers 13 from being fed together. An upper and a lower registration roller 15 and 16 cooperate to feed the leading edge of the paper 13 toward the paper clamper 14 at a preselected timing. A pair of guides 31 guide the leading edge of the paper 13 toward the nip between the registration rollers 15 and 16 and the paper clamper 14.

A driving device, not shown, moves the paper tray 17 in the up-and-down direction such that the top paper 13 on the tray 17 constantly contacts the pick-up roller 18 with a preselected pressure which allows the top paper 13 from being fed out. A front fence 20A is mounted at the left end of the paper tray 17, as viewed in FIG. 7, for positioning the leading edges of the papers 13 stacked on the tray 17. The registration rollers 15 and 16 are rotatably supported by the previously mentioned side walls at a position downstream of the separator pad 20 in the direction of paper conveyance X. The registration rollers 15 and 16 convey the paper 13 at a speed equal to the peripheral speed of the ink drum 1.

The paper feeding section 39 is unique in the following respects. A stepping motor 100 is exclusively assigned to the pick-up roller 18 and drives it independently of the main motor 51. This drive system is different from the conventional sector gear type drive system driving the pick-up roller 18. In addition, a stepping motor 102 is exclusively assigned to the lower registration roller 16 and drives it independently of the main motor 51. This drive system is also different from the conventional sector gear type drive system driving the two registration rollers 15 and 16. The stepping motor 102 eliminates the need for a on-way clutch and other mechanical parts for braking the registration rollers 15 and 16 and regulating the direction of rotation of the same, and thereby reduces the cost. Further, with the stepping motor 102, it is possible to separate the registration roller driveline from the main motor 51 assigned to the ink drum 1 and press drum 8. This not only reduces the load on the registration roller driveline, but also reduces power and therefore cost required of the main motor 51. If such advantages are not essential, then use may be made of the sector gear system including a cam rotatable in synchronism with an ink drum and a sector gear provided with a cam follower engageable with the cam, as taught in, e.g., FIG. 3 of Japanese Patent Laid-Open Publication No. 8-59031.

As stated above, the registration rollers 15 and 16 convey, at a preselected timing, the leading edge of the paper 13 (plain paper or similar thin paper to be described later) toward the paper clamper 14 of the press drum 8 brought to its paper clamp position.

The stepping motor 100 plays the role of pick-up roller drive means for causing the pick-up roller 18 to rotate. A drive pulley, not shown, is mounted on the output shaft of the stepping motor 100 while a driven pulley, not shown, is mounted on the shaft of the separator roller 19. A toothed endless belt 101 is passed over the drive pulley and driven pulley. Another endless toothed belt 18A is passed over the driven pulley of the separator roller 19 and a driven pulley, not shown, mounted on the shaft of the pick-up roller 18. The stepping motor 100 is drivably connected to the pick-up roller 18 by the toothed belts 101 and 18A. The stepping motor 100 causes the pick-up roller 18 to rotate clockwise, as viewed in FIG. 7. A one-way clutch, not shown, is built in the shaft of each of the pick-up roller 18 and separator roller 19, so that the rollers 18 and 19 each is rotatable only in the clockwise direction.

As shown in FIGS. 5 and 7, the stepping motor 102 plays the role of registration roller drive means for causing the lower registration roller 16 to rotate. A drive pulley 102A is mounted on the output shaft of the stepping motor 102 while a driven pulley 16A is mounted on the shaft of the lower registration roller 16. An endless toothed belt 103 is passed over the drive pulley and driven pulley. The stepping motor 102 is therefore drivably connected to the lower registration roller 16 by the toothed belt 103, so that the registration roller 16 is rotated counterclockwise, as viewed in FIG. 7.

Figure 8:
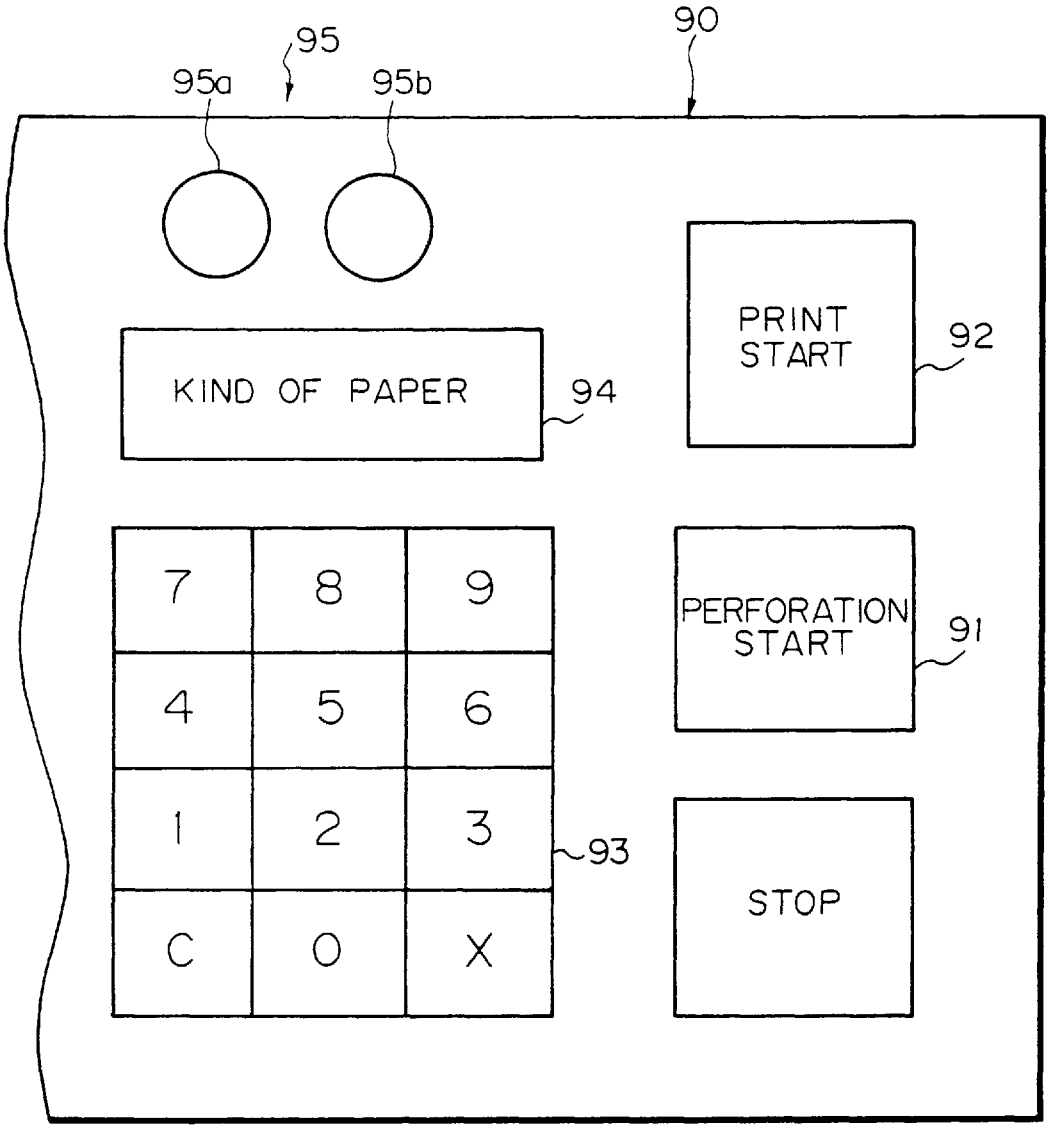
FIG. 8 is a plan view of an operation panel included in the printer of FIG. 7.

As shown in FIG. 8, the operation panel 90 includes a perforation start key for causing a sequence of steps from the reading of a document image to the feed of a master to start. Numeral keys 93 are available for entering, e.g., a desired number of printings. A print start key 92 is used to cause the printer to start outputting a desired number of printings input on the numeral keys 93. A kind-of-paper key or kind-of-paper setting means 94 allows the operator to input the kind of the paper 13 when the paper 13 is a thick paper or similar particular kind of paper. A group of lamps 95 are implemented by LEDs (Light Emitting Diodes) each being assigned to a particular kind of paper input on the key 94 or sensed by a paper sensor 85, FIG. 9, which will be described later.

The group of lamps 95 are made up of a lamp 95*a* for indicating that plain papers are selected, and a lamp 95*b* for indicating that thick papers are selected. When the kind-of-paper key 94 is pressed once, the lamp 95*a* turns on. When the key 94 is pressed twice, the lamp 95*b* turns on while the lamp 95*a* turns off. This informs the user or the operator of the kind of paper selected.

This embodiment and the second and third embodiments to follow each assumes only plain papers and thick papers for the simplicity of description. Of course, for mode delicate control over paper feed, an arrangement may be so made as to allow the operator to input or to automatically sense other various kinds of papers also, e.g., drawing papers, postcards, and envelopes which are far thicker than plain papers.

Reference will be made to FIGS. 5, 7 and 9 for describing a control system included in the first embodiment. As shown in FIG. 7, the press drum 8 includes a front end wall 8A. Two screen plates 105 and 106 are affixed to the outside of the end wall 8A by screws and spaced from each other by a preselected distance in the radial and circumferential directions of the press drum 8. The screen plates 105 and 106 each is formed of sheet steel or synthetic resin and has a generally L-shaped section, as seen in a front view and a side elevation, whose free end protrudes forward.

Photointerrupter type photosensors 104 and 107 are affixed to the inside of the arm 28*a* by screws and spaced from each other in the radial direction of the press drum 8. The photosensors 104 and 107 each is a conventional transmission type optical sensor having a light emitting portion and a light-sensitive portion. The photosensors 104 and 107 may be replaced with reflection type photosensors or microswitches each having a mechanical contact, if desired. The screen plate 105 and photosensor 104 are positioned such that the screen plate 105 intercepts light only when the press drum 8 is rotated counterclockwise to a preselected angular position. The screen plate 105 and photosensor 104 cooperate as paper feed timing determining means for determining a timing for the leading edge of the paper 13 to be fed toward the registration rollers 15 and 16. The screen plate 105 is mounted on the end wall 8A such that when the trailing edge of the paper 13 of size A3 (plain paper) moves away from the nip between the registration rollers 15 and 16, the screen plate 105 meets the photosensor 104 and causes it to output an ON signal. In response to the ON signal, the stepping motor 100 and therefore the pick-up roller 18 is caused to start rotating.

The screen plate 106 and photosensor 107 are positioned such that the screen plate 106 intercepts light only when the press drum 8 is rotated counterclockwise to a preselected angular position. The screen plate 106 and photosensor 107 play the role of timing determining means for determining a timing for the leading edge of the paper 13 to be driven toward the paper clamper 14. In addition, the screen plate 106 and photosensor 107 play the role of rotational position sensing means for sensing the rotational position of the paper clamper 14. Assume a distance from the nip between the registration rollers 15 and 16 to the position where the leading edge of the paper 13 abuts against the paper clamper 14, and a distance, as measured on the outer periphery of the press drum 8, from the angular position of the press drum 8 where the screen plate 106 meets the photosensor 107 and causes it to output an ON signal to the paper clamper 14 against which the leading edge of the paper 13 is abutted. Then, the screen plate 106 is positioned on the end wall 8A such that the above two distances are equal to each other.

As shown in FIG. 9, the control system includes a printer control unit 115 for controlling the entire stencil printer. The printer control unit 115 is implemented as a microcomputer including a CPU (Central Processing Unit), an I/O (Input/Output) port, a ROM (Read Only Memory), a RAM (Random Access Memory) and a timer connected together by a signal bus, although not shown specifically. In FIG. 9, a top-bottom shifting device 80, a top-bottom drive motor 138 and an encoder 136 indicated by dash-and-dots lines, the paper sensor 85 indicated by a dashed line and a solenoid 196 indicated by a bold solid line are not used in this embodiment. It is to be noted that FIG. 9 shows only the major constituent parts to be controlled in accordance with the present invention. Constituent parts not shown in FIG. 9 will sometimes be referred to in relation to the operation of the illustrative embodiment, as needed.

The ON/OFF signals and data signal output from the photosensors 104 and 107 and encoder 136, respectively, are sent to the CPU (or printer control unit 115 as sometimes referred to) via the I/O port. The ON/OFF signals and data signals output from the perforation start key 91, print start key 92, numeral keys 93 and kind-of-paper key 94 arranged on the operation panel 90 are sent to the printer control unit 115 via the input port.

The printer control unit 115 sends, via the output port, various kinds of control signals to the lamps 95*a* and 95*b* (not shown in FIG. 9), various displays, main motor 51, parts included in the master make and feed driver 33 and to be controlled, pulse motor 43 of the driver 33, stepping motors 100 and 102 included in the paper feeding section 39, top-bottom drive motor 138, and solenoid 196 used to retract the clamper actuating cam.

In the illustrative embodiments, the printer control unit 115 has the following functions (1)–(5).

(1) In response to the output signal of the photosensor 104, the printer control unit 115 controls the stepping motor 100 in order to feed the leading edge of the paper 13 toward the registration rollers 15 and 16. In this sense, the printer control unit 115 plays the role of pick-up roller drive control means.

(2) When the paper 13 is a plain paper, the printer control unit 115 controls, in response to the output signal of the photosensor 107, the stepping motor 102 such that the leading edge of the paper 13 is driven at the same time as the paper clamper 14 reaches its paper clamp position. In this sense, the print control unit 115 plays the role of registration roller drive control means.

(3) When the paper 13 is implemented as a thick paper, the printer control unit 115 plays the role of control means for feeding the leading edge of the paper 13 to a position where the leading edge will not be clamped by the paper clamper 14. Specifically, the printer control unit 115 varies the timing for driving the thick paper 13 toward the paper clamper 14 such that the leading edge of the paper 13 is shifted to the upstream side in the direction X by a preselected amount with respect to the paper clamper 14.

(4) When the paper 13 is implemented as a thick paper, the printer control unit 115 controls, in response to the output signal of the photosensor 107, the stepping motor 102 in such a manner as to delay the above paper feed timing, compared to the case with the plain paper 13.

(5) When the paper 13 is implemented as a thick paper, the print control unit 115 controls the pulse motor 43 of the master making section 37 in such a manner as to delay the position of the thermal head 41 for starting making the master 4 by an amount corresponding to the above delay of the paper feed timing of the stepping motor 102.

Figure 11:
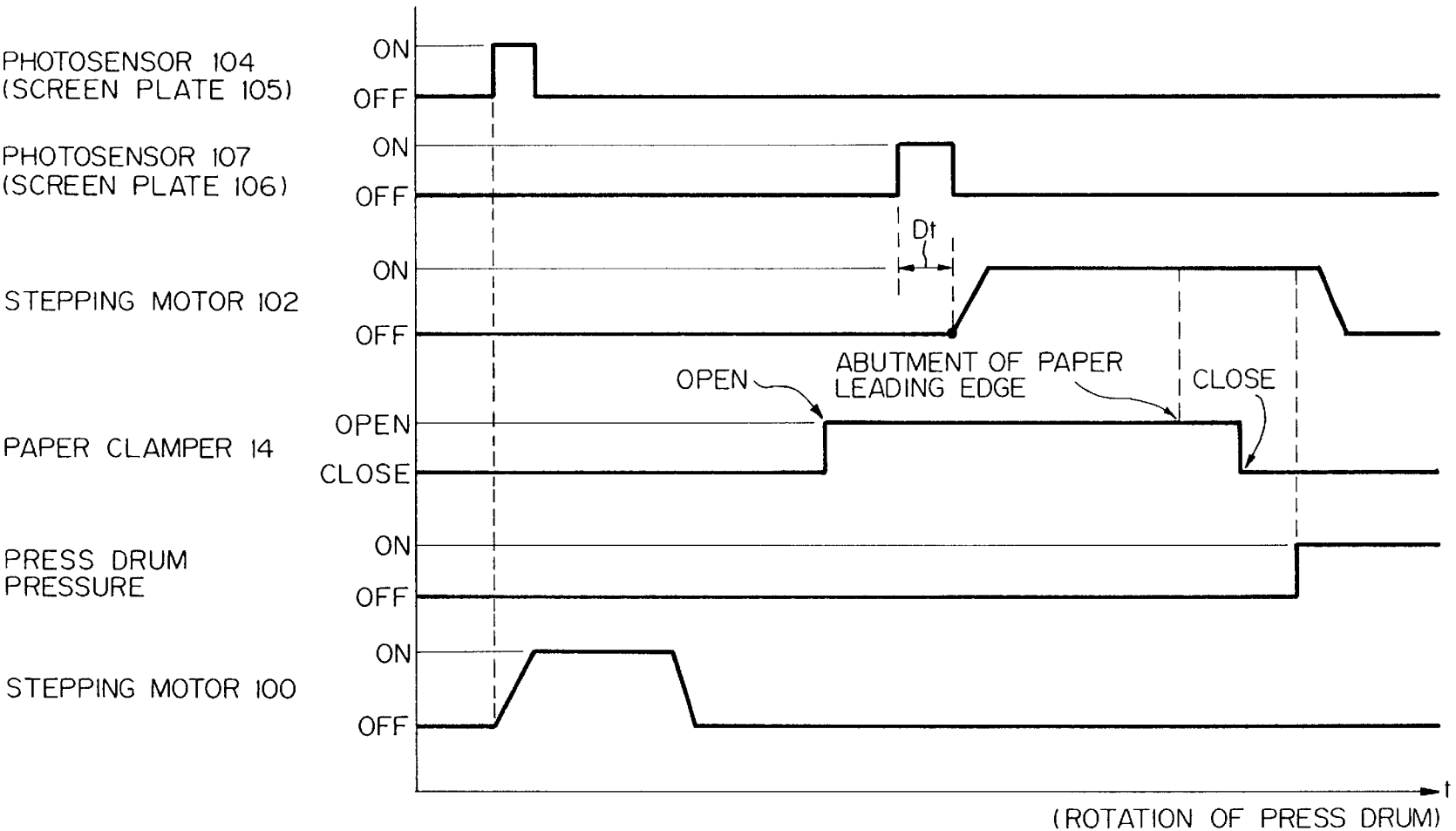
FIG. 11 is a timing chart representative of a paper feed and paper feed control procedure to be effected by the printer of FIG. 7 in the plain paper mode.

The ROM of the printer control unit 115 stores beforehand a program relating to the contents of control shown in FIG. 11 and determined by experiments as well as a sequence of steps which will be described later. The RAM of the printer control unit 115 temporarily stores the results of arithmetic operations output from the CPU, and stores the output signals of the photosensors 104 and 107, the output pulse signal of the encoder 136, and the output signal of the paper sensor 85, as needed.

The operation of the first embodiment will be described with reference to FIGS. 5–16. In FIGS. 12–16, the press drum 8 is shown in a slightly simplified configuration, and the details of the clamper base 12 are not shown.

First, assume that the paper 13 is implemented by a plain paper. The operator confirms the plain papers 13 stacked on the paper tray 17 or loads the paper tray 17 with plain papers, and then presses the kind-of-paper key 94 once. As a result, the lamp 95*a* on the operation panel 90 turns on while the printer control unit 115 sets up a plain paper mode. At the same time, the paper tray 17 is raised by the driving device, not shown, until the top paper 13 contacts the pick-up roller 18 with a preselected pressure.

Subsequently, the operator sets a desired document on the scanner and then presses the perforation start key 91. In response, the ink drum 1 is rotated so as to cause the master discharging section 38 to remove a used master 4 from the ink drum 1 and discharge it. As soon as the master clamper 3 is brought to its master feed position substantially just beside the right end of the ink drum 1, as viewed in FIG. 7, the ink drum 1 is brought to a stop. In this condition, the master clamper shaft is rotated to open the master clamper 3.

After the opening of the master clamper 3, the pulse motor 43 of the master making section 37 is energized to start rotating the platen roller 42. The platen roller 42 conveys the stencil 4 while paying it out from the roll 40. The scanner starts reading the image of the document. The resulting image signal output form the scanner is sequentially processed by the A/D converting section and master making control section to turn out a digital image signal. The heating elements of the thermal head 41 are selectively energized in accordance with the digital image signal, selectively perforating the stencil 4 with heat. The leading edge of the stencil 4 being perforated is conveyed by the platen roller 42 toward the master clamper 3 held in its open position. When the number of steps of the pulse motor 43 reaches a preselected value, the master clamper shaft 3*a* is rotated to close the master clamper 3. As a result, the master clamper 3 clamps the leading edge portion of the perforated part of the stencil 4.

At the same time as the master clamper 3 clamps the stencil 4, the ink drum 1 and press drum 8 are rotated at a peripheral speed substantially equal to the speed at which the master 4 is conveyed. The perforated part of the stencil 4 is therefore sequentially wrapped around the ink drum 1. When the stencil 4 is wrapped around the ink drum 1 over a preselected length, the ink drum 1, press drum 8 and platen roller 42 are caused to stop rotating. At the same time, the cutter motor 46 is energized so as to lower the upper cutter member 44 via the eccentric cam 45. As a result, the perforated part of the stencil 4 is cut away and tuns out a master 4. Then, the ink drum 1 is again caused to rotate clockwise in order to pull the trailing edge, not shown, of the master 4 out of the master making section 37. The master 4 is therefore entirely wrapped around the ink drum 1.

Figure 12:
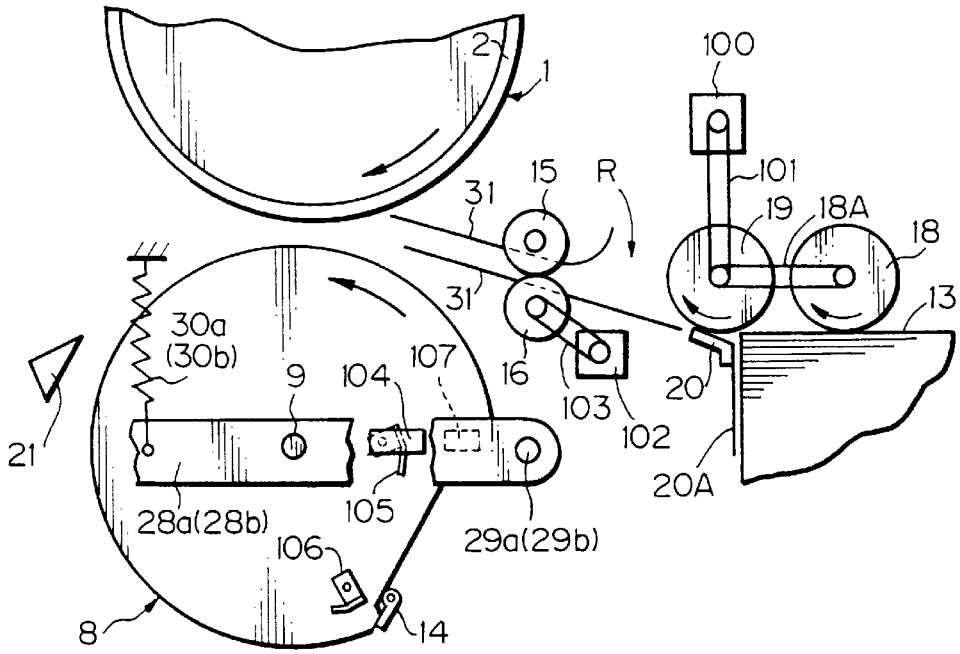
FIGS. 12–16 are front views demonstrating the consecutive stages of operation of the printer of FIG. 7.
Figure 13:
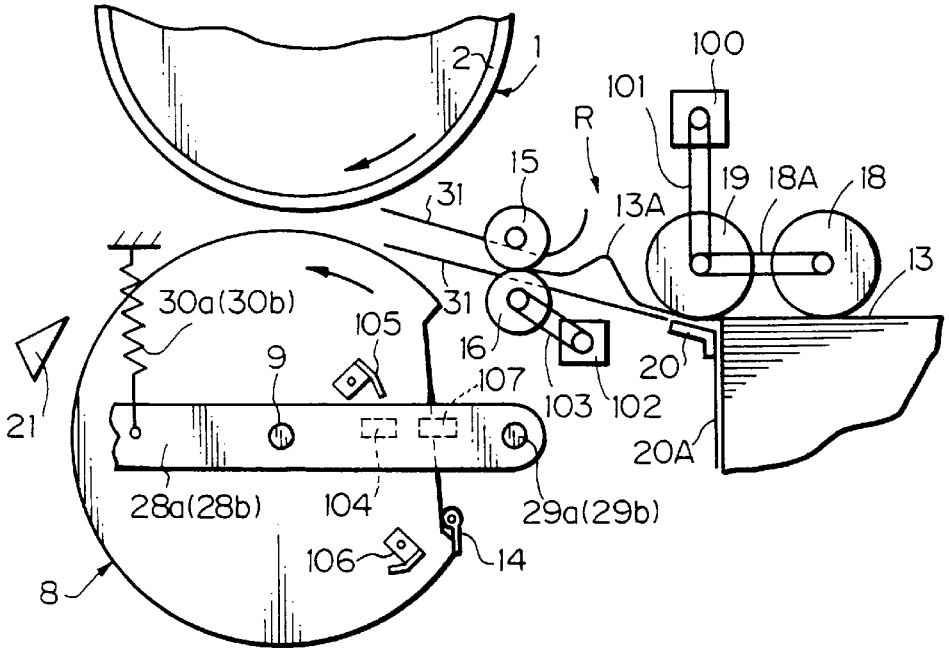

The conveyance of the paper 13 will be described with reference to FIGS. 12–16. As shown in FIG. 12, assume that the press drum 8 is rotated counterclockwise until the screen plate 105 meets the photosensor 104. Then, the photosensor 104 outputs an ON signal and sends it to the printer control unit 115. In response, the printer control unit 115 causes the stepping motor 100 to start rotating. As a result, the pick-up roller 18 is rotated clockwise while picking up the top paper (plain paper) 13. At this instant, the separator roller 19 and separator pad 20 cooperate to prevent the papers 13 underlying the top paper 13 from being fed together. As a result, only the top paper 13 is fed toward the registration rollers 15 and 16. After the leading edge of the paper 13 has abutted against the nip between the registration rollers 15 and 16, the paper 13 is further conveyed to form a preselected amount of upward loop 13A, as shown in FIG. 13. At this time, the pick-up roller 18 and separator roller 19 are brought to a stop.

In the above condition, the paper 13 is fed by a preselected amount which is 5 mm to 6 mm greater than the distance between the nip between the registration rollers 15 and 16 and the front fence 20A, as measured on the paper transport path R. To so control the stepping motor 100, the printer control unit 115 converts the above amount of paper feed to a number of steps and then sends a command signal representative of the number of steps to the stepping motor 100. As a result, the paper 13 is fed by the pick-up roller until it forms the loop 13A.

Figure 14:
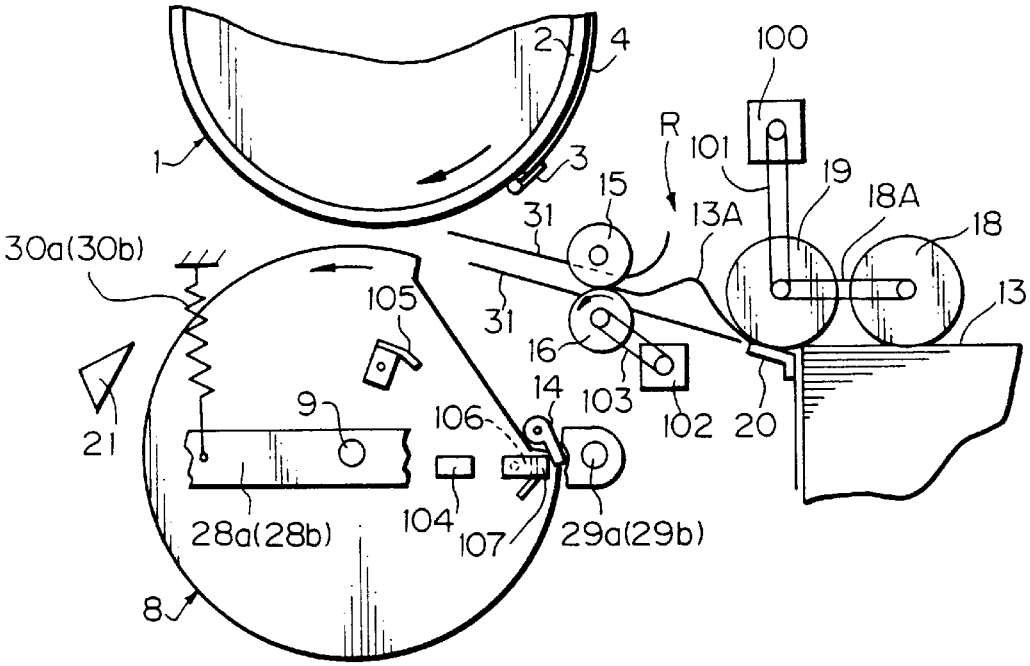
Figure 15:
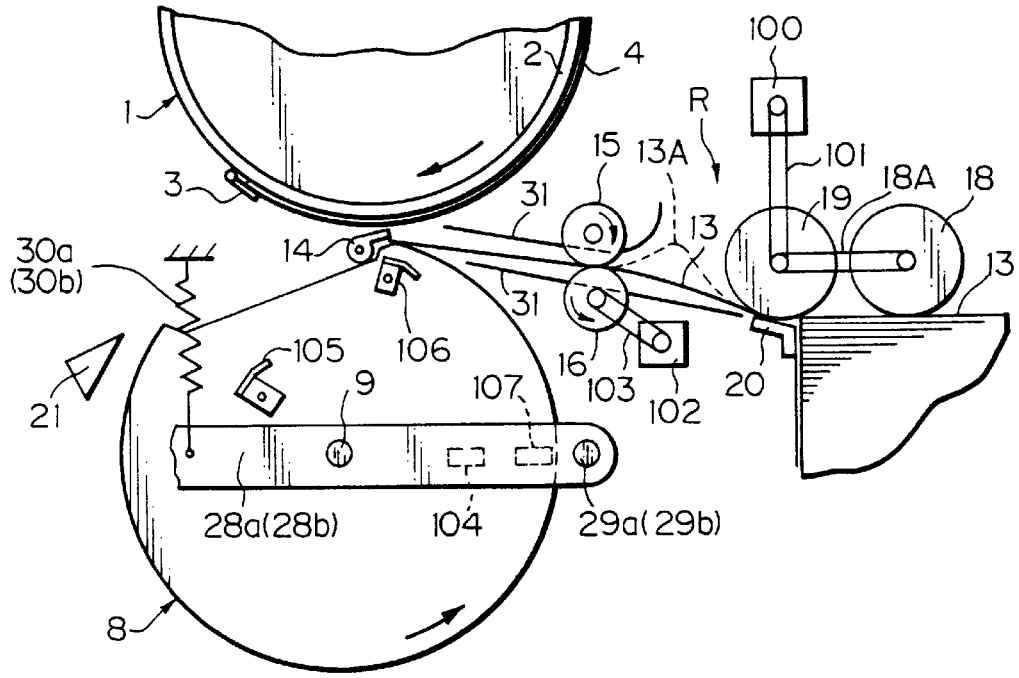

As shown in FIG. 14, the press drum 8 is further rotated counterclockwise. When the screen plate 106 meets the photosensor 107 at a preselected timing, the photosensor 107 generates an ON signal and sends it to the printer control unit 115. As shown in FIG. 11, the printer control unit 115 energizes the stepping motor 102 on the elapse of a preselected delay time Dt. As a result, the stepping motor 102 starts rotating the lower registration roller 16 counterclockwise. Consequently, as shown in FIG. 15, the loop 13A (indicated by a dashed line) of the paper 13 disappears. At this instant, the pick-up roller 18 and separator roller 19 each rotates in accordance with the movement of the paper 13 due to the function of the associated one-way clutch. The paper 13 is conveyed until its leading edge abuts against the paper clamper 14 of the press drum 8 held in its open position.

As shown in FIGS. 10 and 15, as soon as the leading edge of the paper 13 abuts against the paper clamper 14, the clamper 14 is closed. The press drum 8 is rotated with the paper clamper 14 retaining the leading edge portion of the paper 13, so that the leading edge portion is brought to the gap between the ink drum 1 and the press drum 8. At this instant, the printer control unit 115 sends a command signal to the stepping motor 102 such that the paper 13 is fed at a speed about 1.1 times as high as the peripheral speed of the press drum 8.

Because the stepping motor 102 rotates the lower registration roller 16 via the endless toothed belt 103, the rotation of the roller 16 is sometimes delayed due to, e.g., the slacking of the belt 103. In light of this, the feed speed of the stepping motor 102 is made higher than the peripheral speed of the press drum 8, as stated above. Even after such correction, the paper 13 reaches the paper clamp position earlier than the paper clamper 14 and brings about a jam because the paper 13 moves at a speed higher than the peripheral speed of the press drum 8. This is why the delay time Dt is provided between the time when the stepping motor 102 starts rotating and the time when the photosensor 107 outputs an ON signal. That is, the feed speed of the paper 13 higher than the peripheral speed of the press drum 8 and the delay time Dt are successful to compensate for a scatter among machines, e.g., the play of the drive mechanism. This allows the paper clamper 14 to surely clamp the leading edge portion of the paper 13 at the paper clamp position.

Figure 16:
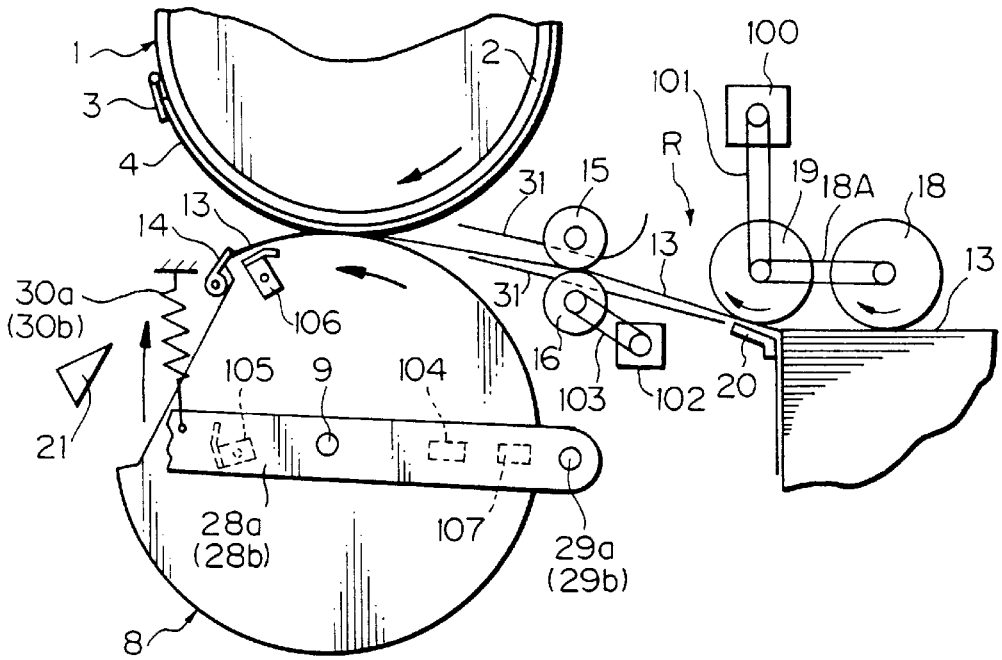

As shown in FIG. 16, the springs 30*a* and 30*b* of the moving device 70 cause the press drum 8 to move upward toward the ink drum 1, so that a nip is formed between the drums 1 and 8. As a result, the paper 13 brought to the gap between the ink drum 1 and the press drum 8 is pressed against the ink drum 1 by the press drum 8.

In this manner, the paper 13 is continuously pressed by the press drum 8 against the master 4 wrapped around the drum 1 which is in rotation. This causes the master 4 to closely contact the ink drum 1 and causes the ink I to ooze out to the perforated area B, FIG. 10, of the master 4 via the pores 2*a* and screen layer 35 of the ink drum 1. The ink I transferred to the front of the paper 13 forms an image 36 (indicated by a bold solid line).

The above printing operation will be described more specifically with reference to FIG. 10. FIG. 10 shows a condition wherein the paper clamper 14 of the press drum 8 is clamping the leading edge portion of the paper (plain paper) 13. The master 4 is wrapped around the screen layer 35 of the ink drum 1 due to the adhering force of the ink I and has its leading edge portion clamped by the master clamper 3 (not shown in FIG. 10). The ink I is fed from the porous area D of the base 2 to the screen layer 35 and therefrom to the perforated area B of the master 4. The print pressure of the springs 30*a* and 30*b* is applied (ON) to the master 4 via the paper 13 just after the paper clamper 14 has clamped the leading edge of the paper 13. At this time, the image 36 begins to be formed on the paper 13 and forms an image area C.

The boundary between the non-porous area 2*b* and the porous area D of the base 2 and the leading edge of the image area C of the paper 13 are spaced by a distance L1. The margin of the paper 13 preceding the leading edge of the image and where no images are printed has the previously mentioned length A. As stated above, the stencil printer successfully operates when the paper 13 is a plain paper or similar ordinary paper.

The ink roller 5 rotates in the same direction as the ink drum 1. The ink I in the ink well 7 is deposited on the ink roller 5 and conveyed by the ink roller 5 to the inner periphery of the ink drum 1 while being regulated in amount by the doctor roller 6.

As the press drum 8 is further rotated, the paper clamper 14 is opened at the paper discharge position short of the peeler 21. The peeler 21 peels off the paper or printing 13 from the press drum 8. As a result, the printing 13 is conveyed to the tray 23 by the conveyor belt 27. In this manner, trial printing for filling the perforations of the master 4 with the ink I is completed. At the same time, the ink drum 1 is released from the press drum 8 and restored to its initial position.

The operator checks the printing produced by the trial printing to see if the quality and position of the image are acceptable or not. If the printing is satisfactory, then the operator inputs a desired number of printings on the numeral keys 93 and then presses the print start key 92. As a result, the above procedure beginning with paper feed and ending with paper discharge is repeated a number of times corresponding to the desired number of printings.

How the stencil printer operates with the paper 13 implemented as a thick paper will be described hereinafter. The thick paper 13 would bring about the previously discussed problems ascribable to the ripping of the master 4. In light of this, the illustrative embodiment urges the operator to input information indicative of the thick paper 13 on the kind-of-paper key 94. In response, the printer control unit 115 controls the structural elements of the master make and feed driver 33 and sheet feeding section 39 such that the leading edge portion of the paper 13 will not clamped by the paper clamper 14.

When the paper 13 is thick, it does not wrap around the ink drum 1 because of its elasticity, as determined by experiments and experience. Therefore, leaving the leading edge portion of the paper 13 unclamped does not matter at all. The thick paper 13 having its leading edge portion left unclamped is shown in FIG. 5.

Specifically, the operator conforms that the papers 13 stacked on the paper tray 17 are thick papers, or stacks thick papers on the paper tray 17. Then, the operator presses the kind-of-paper key 94 twice. In response, the lamp 95*b* turns on to indicate that a thick paper mode unique to the present invention has been set. At the same time, the paper tray 17 is raised such that the top paper (thick paper) 13 contacts the pick-up roller 18 with a preselected pressure.

The operator lays a desired document on the scanner and presses the perforation start key 91. In response, the master discharging operation is executed in the same manner as in the plain paper mode, and then the print drum 1 waits for a master 4. Subsequently, the platen roller 42 starts rotating and conveys the stencil 4 while paying it out from the roll 40. At this instant, the printer control unit 115 controls the pulse motor 43 in order to execute paper feed control unique to the thick paper mode. Briefly, the paper feed control is such that the perforation start position of the thermal head 41 is delayed by an amount corresponding to the delay of the paper feed timing of the stepping motor 102. As shown in FIG. 12, the position where the end 14*a* of the paper clamper 14 is expected to clamp the paper 13 and the leading edge of the paper 13 are spaced by a distance E (unclamp length hereinafter). The above paper feed control can be done if the platen roller 42 is rotated to feed the leading edge of the stencil 4 by an amount corresponding to the unclamp length E without causing it to be perforated.

In parallel with the image reading operation, the master making operation is effected in the same manner as in the plain paper mode. The platen roller 42 conveys the stencil 4 toward the master clamper 3 held in its open position. When the number of steps of the pulse motor 43 reaches a preselected value (the number of steps assigned to the plain paper mode plus the number of steps needed to convey the stencil 4 by the amount corresponding to the unclamp length E), the master clamper shaft 3*a* is rotated to close the master clamper 3. As a result, the perforated part of the stencil, i.e., master 4 has its leading edge clamped by the master clamper 3. This is followed by the same procedure as in the plain paper mode, so that the master 4 is fully wrapped around the ink drum 1.

Subsequently, the paper (thick paper) 13 is fed in the manner described with reference to FIGS. 12 and 13. As the press drum 8 is further rotated counterclockwise, the screen plate 106 meets the photosensor 107 at the preselected timing and causes it to send an ON signal to the printer control unit 115. In response, the printer control unit 115 drives the stepping motor 102 at a timing different from the timing assigned to the plain paper mode. Consequently, the lower registration roller 16 is rotated counterclockwise, causing the loop 13A of the paper 13, FIG. 15, to disappear.

FIGS. 5 and 6 demonstrate the paper feed and paper feed control particular to the thick paper mode. As shown, to prevent the leading edge portion of the thick paper 13 from being clamped by the paper clamper 14, the printer control unit 115 causes the stepping motor 102 to vary the timing at which the lower registration roller 16 drives the leading edge of the paper 13 toward the paper clamper 14. As a result, the leading edge of the paper 13 is shifted to the upstream side in the direction X with respect to the paper clamper 14. Stated another way, in response to the output signal of the photosensor 107, the printer control unit 115 so controls the stepping motor 102 as to delay the timing for the lower registration roller 16 to convey the leading edge of the paper 13 by a period of time corresponding to the unclamp length E, compared to the plain paper mode. This successfully prevents the paper clamper 14 from contacting the master 4 wrapped around the ink drum 1 and thereby solves the previously discussed problems.

The leading edge of the thick paper 13 is conveyed toward the paper clamper 14 with the pick-up roller 18 and reverse roller 19 being rotated by the paper 13 due to the function of their one-way clutches. However, the paper clamper 14 is closed without clamping the paper 13.

The press drum 8 is moved upward toward the ink drum 1 due to the action of the springs 30*a* and 30*b* of the moving device 70, thereby forming the nip between the drums 8 and 1. The paper 13 conveyed to the above nip, but not clamped by the paper clamper 114, is pressed against the ink drum 1 by the press drum 8. As the paper 13 is continuously pressed against the master 4, the ink I is transferred from the porous portion 2*a* and screen layer 35 of the base 2 to the paper 13 via the perforated area B' of the master 4 in the same manner as in the plain paper mode.

More specifically, as shown in FIG. 6, the timing for the lower registration roller 16 to convey the leading edge of the paper 13, i.e., for the two registration rollers 15 and 16 to start rotating is delayed by a period of time corresponding to the unclamp length E, thereby shifting the position of the leading edge of the paper 13 with respect to the paper clamper 14. Therefore, despite that the paper 13 is thick, the end 14*a* of the paper clamper 14 is prevented from contacting the master 4 wrapped around the ink drum 1. Because the signal for so controlling the lower registration roller 16 is derived from the rotation of the press drum 8, the registration rollers 15 and 16 are capable of conveying the paper 13 at the above delayed timing accurately without any irregularity.

The master 4 is perforated over the area B' while the image 36 is printed on the paper 13 over an area C' coincident with the area B'. The leading edge margin A of the paper 13 has the same length as in the plain paper mode, and the print ON timing is also the same as in the plain paper mode. The unclamp length E is selected to be about 5 mm to about 10 mm in order to minimize irregularity in the accuracy of paper feed and the reduction of the image area. In FIG. 6, L2 indicates the distance, in the thick paper mode, between the boundary between the non-porous area 2*b* and the porous area D of the base 2 and the leading edge of the image area C' of the paper 13. The distance L2 is the sum of the distance L1 particular to the plain paper mode and unclamp length E, i.e., L2=L1+E.

As the press drum 8 is further rotated, the paper clamper 14 is opened at the paper discharge position short of the peeler 21. The peeler 21 peels off the paper or printing 13 from the press drum 8. As a result, the printing 13 is conveyed to the tray 23 by the conveyor belt 27. In this manner, trial printing for filling the perforations of the master 4 with the ink I is completed. At the same time, the ink drum 1 is released from the press drum 8 and restored to its initial position.

The operator checks the printing produced by the trial printing to see if the quality and position of the image are acceptable. If the printing is satisfactory, then the operator inputs a desired number of printings on the numeral keys 93 and then presses the print start key 92. As a result, the above procedure beginning with paper feed and ending with paper discharge is repeated a number of times corresponding to the desired number of printings.

As stated above, the illustrative embodiment achieves the following advantages (1)–(6).

(1) In the stencil printer including the press drum 8 with the paper clamper 14, the screen plate 106 and photosensor 107 for determining the timing for the leading edge of the paper (plain paper) 13 to be fed toward the paper clamper 14 are mounted on the press drum 8. This allows the paper clamper 14 to surely clamp the leading edge portion of the paper 13 and thereby prevents the paper 13 from wrapping around the ink drum 1. In addition, the paper 13 can be surely and reliably driven at a preselected timing, so that accurate registration is enhanced.

(2) A delay time exists between the time when the photosensor 107 starts outputting an ON signal due to the screen plate 106 and the time when the stepping motor 102 starts rotating. The delay time facilitates control using software and adjusts a scatter among machines as to, e.g., play.

(3) The stepping motor 102 playing the role of registration roller drive means eliminates the need for mechanical parts for regulating the braking and the direction of rotation of the registration rollers, thereby reducing the cost of the stencil printer. Further, the drive mechanism assigned to the registration rollers 15 and 16 is independent of the main motor 51 assigned to the ink drum 1 and press drum 8 and therefore free from heavy loads. In addition, power and therefore cost required of the main motor 51 is reduced.

(4) The screen plate 105 and photosensor 104 for determining the timing for the leading edge of the paper (plain paper) 13 to be fed are also mounted on the press drum 8, so that stable and reliable paper feed timing is insured.

(5) The stepping motor 100 playing the role of pick-up roller drive means eliminates the need for mechanical parts for regulating the direction of rotation of the pick-up roller 18, thereby reducing the cost of the stencil printer. Further, the drive mechanism assigned to the pick-up roller 18 and separator roller 19 is independent of the main motor 51 assigned to the ink drum 1 and press drum 8 and therefore free from heavy loads. In addition, power and therefore cost required of the main motor 51 is further reduced.

(6) Even when the paper 13 is implemented as an envelope or similar thick paper, it is possible to prevent the paper 13 from wrapping around the ink drum 1 or ripping the master 4 without resorting to any modification of the basic arrangement around the press drum 8. The stencil printer therefore obviates, e.g., the contamination of printings ascribable to the ink penetrating through the ripped portions of the master.

2nd Embodiment

This embodiment differs from the first embodiment except for the following. In the second embodiment, the previously mentioned top-bottom shifting device or top bottom adjusting means 80 (see FIGS. 21 and 22) varies the phase of the ink drum 1 or that of the press drum 8 in order to adjust the top-bottom position of the image to be formed on the paper 13 in the direction X. In the first embodiment, the printer control unit 115 so controls the pulse motor 43 of the master make and feed driver 33 as to delay the perforation start position of the thermal head 41 with respect to the stencil 4, as stated earlier. In the second embodiment, the printer control unit 115 controls, in response to the output pulse signal of the encoder 136, FIG. 9, the top-bottom drive motor 138 of the device 80 such that the leading edge of the master 4 is shifted to the upstream side in the direction X with respect to the paper (thick paper) 13.

Figure 20:
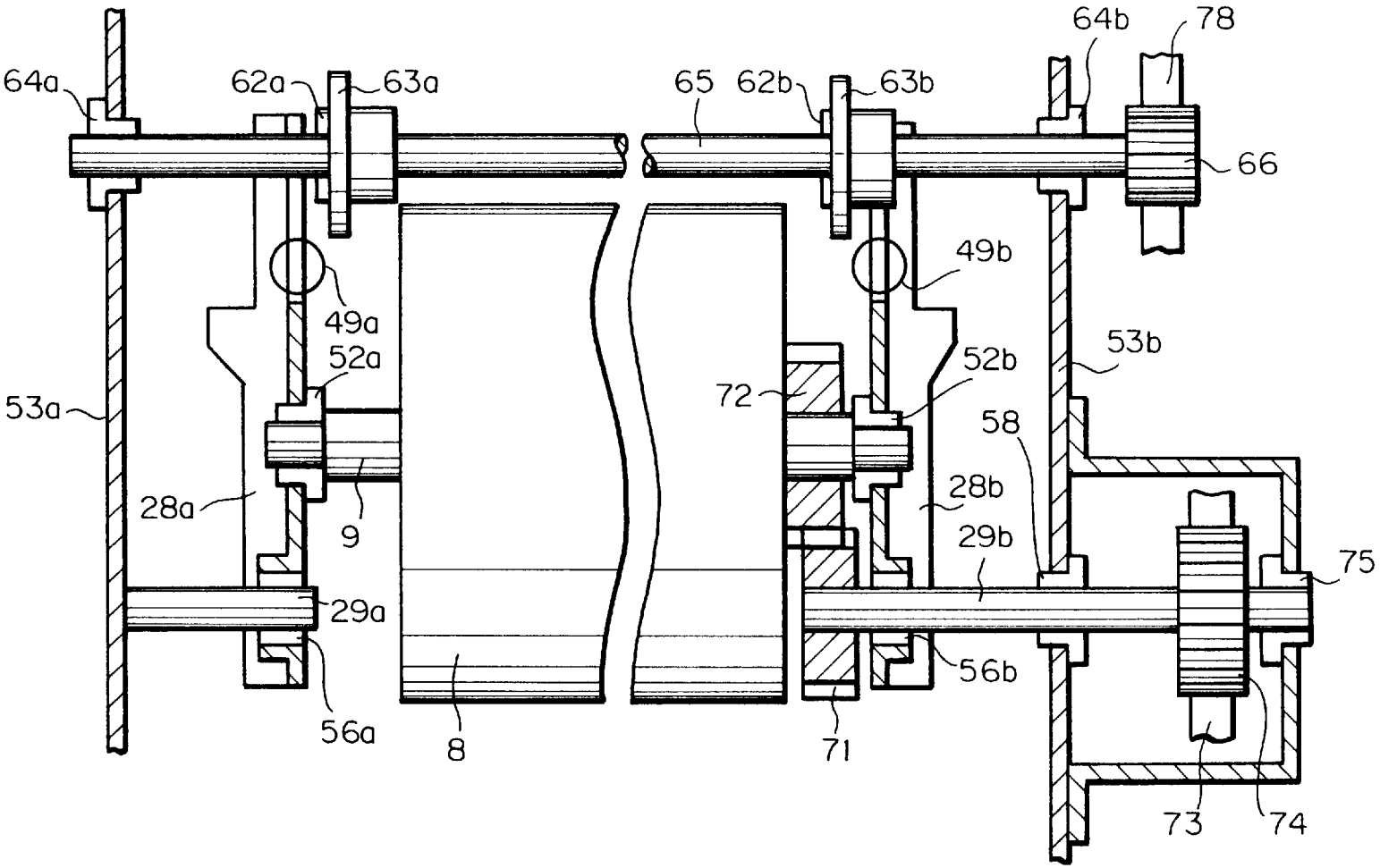
FIG. 20 is a sectional side elevation showing an arrangement around the press drum.

Reference will be made to FIGS. 19–22 for describing a drive mechanism assigned to the ink drum 1 and press drum 8 and an arrangement around the top-bottom shifting device 80. As shown in FIG. 20, the press drum 8 is mounted on the shaft 9. The shaft 9 has its both ends rotatably supported by bearings 52*a* and 52*b* respectively mounted on the arms 28*a* and 28*b* which constitute the moving device 70. One end of the arm 28*a* is supported via a bearing 56*a* by the shaft 29*a* fastened to the side wall 53*a* of the printer. A bearing 56*b* is mounted on one end of the other arm 28*b*. The shaft 29*b* supported by the side wall 53*b* of the printer via a bearing 58 and rotatably supported by the bearing 56*b*.

A gear 71 is mounted on one end of the shaft 29*b* for transferring rotation to the press drum 8. A gear 72 is mounted on the portion of the arm 28*b* adjoining the shaft 9 and is held in mesh with the gear 71. The other end of the shaft 29*b* is supported by a bearing 75. A toothed pulley 74 is mounted on the shaft 29*b* between the bearings 58 and 75 for transferring the rotation of the ink drum 1. A belt 73 is passed over the pulley 74 and a toothed pulley 76 which will be described later. As shown in FIG. 22, a toothed pulley 77 is positioned below the pulley 76 for transferring the rotation of the main motor 51 to the ink drum 1 via the belt 78.

As shown in FIGS. 19 and 20, the cams 63*a* and 63*b* are mounted on a shaft 65 supported by the side walls 53*a* and 53*b* via bearings 64*a* and 64*b*. A toothed pulley 66 is mounted on one end of the shaft 65 while the belt 78 is passed over the pulley 66. The shaft 65 is caused to rotate in synchronism with the ink drum 1 by the main motor 51. The press drum 8 is caused by the cams 63*a* and 63*b* to rotate about the shafts 29*a* and 29*b* between the position where it contacts the ink drum 1 and the position where it is spaced from the drum 1.

As shown in FIG. 19, each of the cam followers 62*a* and 62*b* does not contact the associated cam 63*a* and 63*b*, respectively, over a portion x of the cam. As a result, the press drum 8 is pressed against the ink drum 1 by the springs 30*a* and 30*b*. The cam followers 62*a* and 62*b* each contacts the associated cam 63*a* or 63*b* over a portion y of the cam, releasing the press drum 8 from the ink drum 8.

Figure 21:
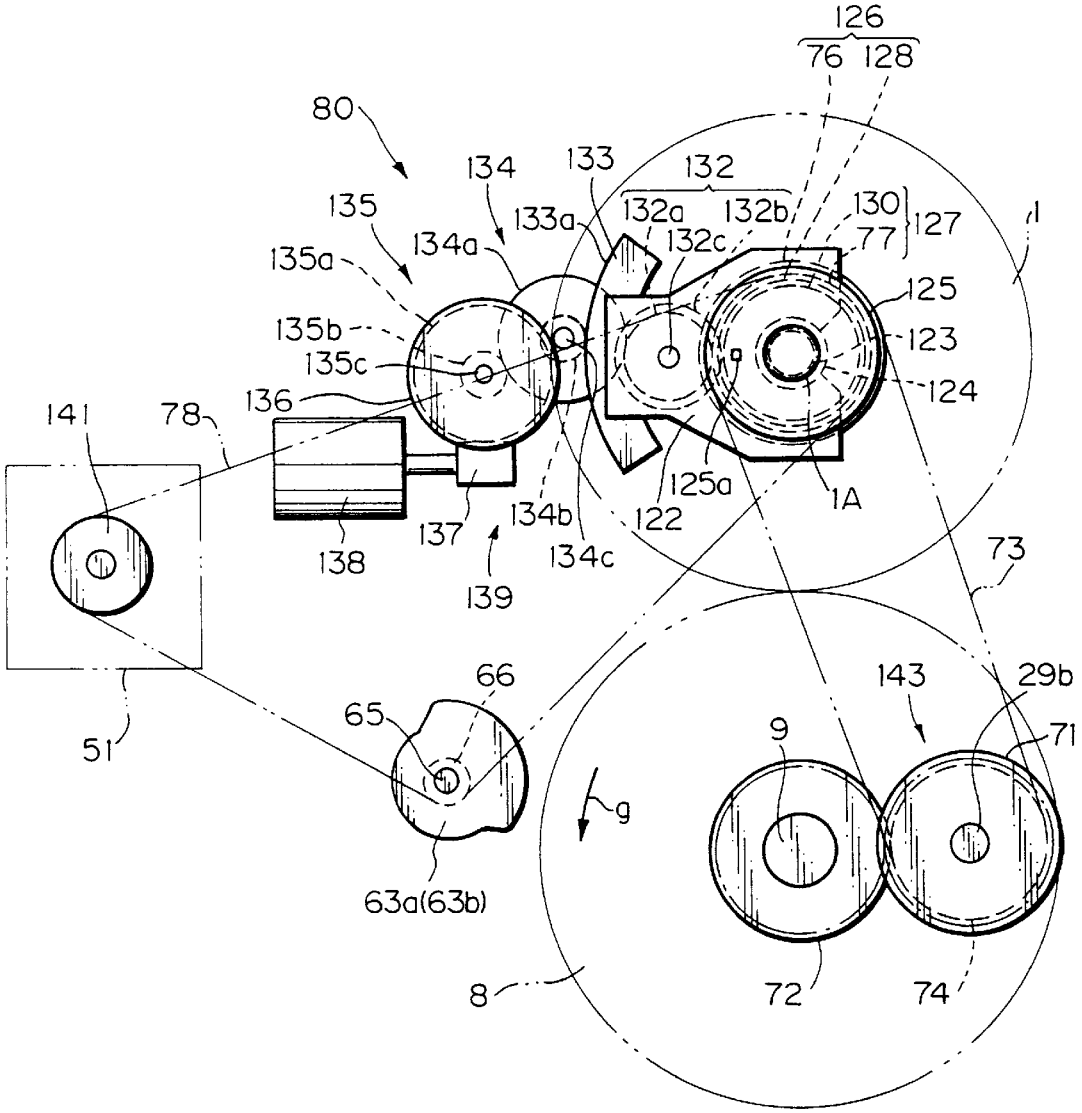
FIG. 21 is a front view showing a drive mechanism and a top-bottom shifting device included in the printer of FIG. 7.

As shown in FIGS. 21 and 22, the top-bottom shifting device 80 is included in the drive mechanism between the pulleys 76 and 77. Generally, the top-bottom shifting device 80 has the following construction. When the position of a printed image and that of a document image are not coincident, a signal is sent from the operation panel 90 to the printer control unit 115. In response, the printer control unit 115 causes the print drum 1 or the press drum 8 to rotate and thereby varies the phase of the drum 1 or 8. As a result, the image position is shifted in the direction in which the paper 13 is conveyed. The shifting device 80 shifts the position of an image relative to the paper 13 either in the direction of paper conveyance or in the direction opposite thereto, i.e., in the top-and-bottom direction. For this purpose, the shifting device 80 may move one or both of the ink drum 1 and the press drum 8 including the clamping means in the top-and-bottom direction.

For the top-bottom shifting device 80, use may be made of an arrangement shown in FIGS. 1 and 2 of the previously mentioned Laid-Open Publication No. 61-198067, top-bottom shifting means 600 shown in FIG. 5 of the previously mentioned Laid-Open Publication No. 7-17121, or a top-bottom adjusting mechanism 21 with a planetary gear shown in FIG. 2 of the previously mentioned Laid-Open Publication No. 4-32917.

The top-bottom shifting device 80 of the illustrative embodiment mainly consists of support arms 122, gears 128 and 130, a rotation transfer member 132, a plate member 133, and rotating means 139 which will be described later. The rotating means 139 mainly consists of the top-bottom drive motor 138 and speed reduction gears 134 and 135 which will also be described later.

Shafts 123 and 124 coaxial with the center shaft 1A are arranged at the rear side of the stencil printer, as seen in a front view. The shaft 123 has its one end or rear end rotatably supported by the rear side wall of the stencil printer and has its other end rotatably supported by the shaft 124. The shaft 123 positioned in front of the shaft 123 rotatably supports the other end of the shaft 123 with its one end and has its other end rotatably supported by a side wall, not shown. A disk 125 is mounted on the other end of the shaft 124 and abuts against the disk 121. The lug 121*a* of the disk 121 is received in a hole 125*a* formed in the disk 125. A bore 124*a* is formed in the shaft 124 for receiving one end of the center shaft 1A.

Gear pulleys 126 and 127 are mounted on the shafts 123 and 124, respectively. The gear pulley 126 is made up of a gear 128 and a pulley 76 while the gear pulley 127 is made up of a gear 130 and a pulley 77. The gears 128 and 130 each has a particular number of teeth. The gear pulleys 126 and 127 are positioned such that the gears 128 and 130 face each other.

The support arm 122 having a generally U-shaped configuration is arranged around the pulleys 76 and 77 and rotatably supported by the shafts 123 and 124 at both ends thereof. A shaft 132*c* is rotatably supported by the portions of the opposite side walls of the support arm 122 adjoining bent portions. The rotation transfer member 132 is mounted on the shaft 132*c*. The rotation transfer member 132 includes a gear portion 132*a* meshing with the gear 128 and a gear portion 132*b* meshing with the gear 130. The plate member 133 includes a sector gear portion 133*a* and is affixed to the outside of the side wall of the support arm 122 adjoining the pulley 76.

The speed reduction gears 134 and 135 are positioned at the left-hand side of the support arm 122, as viewed in FIG. 22. The speed reduction gear 134 includes a larger diameter gear 134*a* and a smaller diameter gear 134*b* which plays the role of a drive gear. This gear 134 is rotatably supported by the opposite side walls, not shown, via a shaft 134*c*. The smaller diameter gear 134*b* is held in mesh with the sector gear portion 133*a*. The speed reduction gear 135 includes a worm wheel 135*a* and a gear 135*b* and is rotatably supported by the opposite side walls, not shown, via a shaft 135*c*. The gear 135*b* is held in mesh with the larger diameter gear 134*a*. The encoder 136 is mounted on one end of the shaft 135*c* for sensing the position of the speed reduction gear 135. The top-bottom drive motor 138 is reversible and positioned below the speed reduction gear 135. A worm 137 is mounted on the output shaft of the motor 138 and held in mesh with the worm wheel 135*a*. In this configuration, the rotation of the motor 138 is transmitted to the plate member 133 via the worm 137, speed reduction gears 135 and 134, and sector gear portion 133*a*. As a result, the support arm 122 is angularly moved with the gears 132*a* and 132*b* of the rotation transfer member 132 rolling on the gears 128 and 130, respectively.

The main motor or drum drive means 51 for rotating the ink drum 1 and press drum 8 is positioned below the top-bottom drive motor 138. A toothed pulley 141 is mounted on the output shaft of the main motor 51. The belt 78 is passed over the toothed pulley 141, the pulley 77 of the gear pulley 127, and the pulley 66.

A gear pulley 143 is located in the vicinity of the right-hand side of the press drum 8 and made up of a shaft 29*b* and the pulley 74 and gear 71 mounted on the shaft 29*b*. The belt 73 is passed over the pulley 74 and the pulley 76 of the gear pulley 126. The gear 71 is held in mesh with the press drum gear 72.

When the main motor 51 is rotated clockwise, as viewed in FIG. 21, its rotation is transmitted to the shaft 124 via the toothed pulley 141, belt 78, and pulley 77. As a result, the ink drum 1 is rotated clockwise, as viewed in FIG. 21, with the center shaft 1A received in the bore 124*a* and with the lug 121*a* received in the hole 125*a*. The ink drum 1, in turn, causes the gear 130 to rotate clockwise. The rotation of the gear 130 is transferred to the gear 128 via the gears 132*b* and 132*a* of the rotation transfer member 132. Further, the rotation of the gear 128 is transmitted to the press drum 8 via the pulley 76, belt 73, pulley 74, gear 71, and press drum gear 72, causing the press drum 8 to rotate counterclockwise.

It is to be noted that the gears 128, 130, 71 and 72, toothed pulley 141, pulleys 76, 77 and 74 and rotation transfer member 132 each has a particular number of teeth allowing the ink drum 1 and press drum 8 to rotate at the same peripheral speed.

Figure 17:
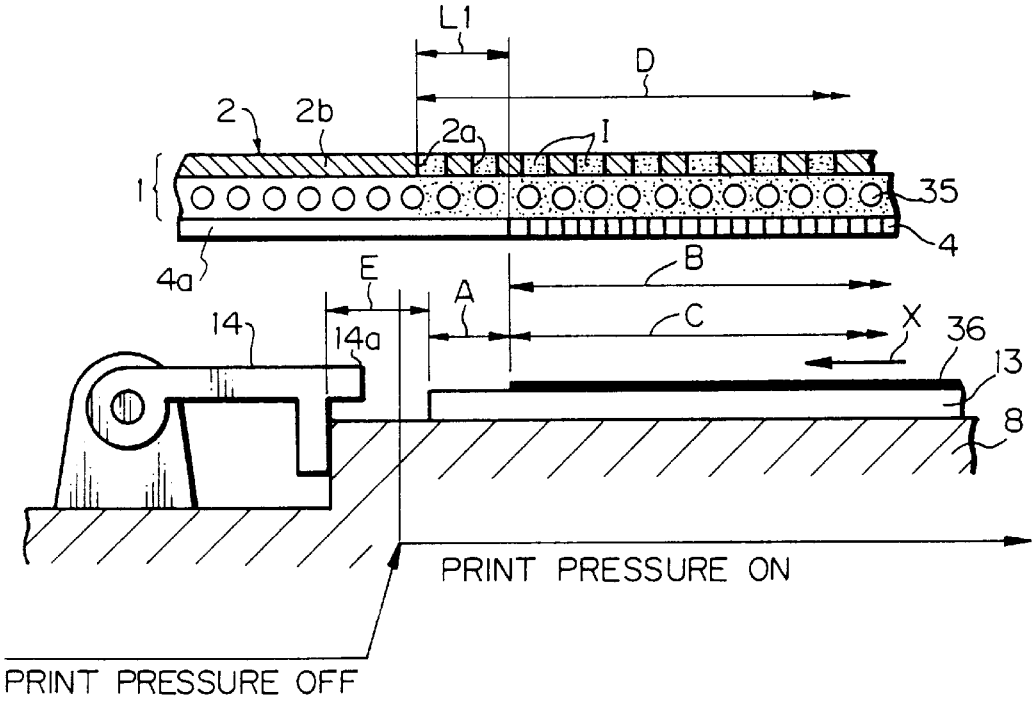
FIG. 17 is a sectional front view showing a positional relation between the hollow cylindrical base, screen layer and master, the press drum, the paper clamper, the paper and the print pressure ON/OFF occurring in the thick paper mode in a second embodiment of the present invention.

Reference will be made to FIGS. 5, 6 and 17 for describing the operation of the second embodiment, particularly the operation different from the operation of the first embodiment. When the paper 13 is a plain paper, the printer control unit 115 sets up the plain paper mode as in the first embodiment and executes printing. When the paper 13 is an envelope or similar thick paper, the illustrative embodiment urges the operator to input information indicative of the thick paper on the kind-of-paper key 94. In response, the printer control unit 115 controls the structural elements of the top-bottom shifting device 80 and paper feeding section 39 to be controlled, so that the leading edge portion of the paper (thick paper) 13 will not be clamped by the paper clamper 14.

When the paper 13 is thick, leaving the leading edge portion of the paper 13 unclamped does not matter at all for the reason stated previously. The thick paper 13 having its leading edge portion left unclamped is shown in FIG. 17.

In the illustrative embodiment, as in the previous embodiment, the leading edge of the paper (thick paper) 13 is delayed with respect to the paper clamper 14 by an amount corresponding to the unclamp length E. In addition, the top-bottom shifting device 80 automatically varies the phase of the ink drum 1 or that of the press drum 8 in the direction of rotation. As a result, the leading edge of the stencil 4 is fed by the platen roller 42 without being perforated in the same manner as in the previous embodiment. This alternative scheme does not change the length A of the leading edge margin stated earlier, and moreover makes it needless to delay the perforation start position of the thermal head with respect to the stencil 4. That is, the distance L1 shown in FIG. 17 is the same as the distance L1 shown in FIG. 10 and does not have to be replaced with the distance L2 of FIG. 6.

Specifically, the operator conforms that the papers 13 stacked on the paper tray 17 are thick papers, or stacks thick papers on the paper tray 17. Then, the operator presses the kind-of-paper key 94 twice. In response, the lamp 95*b* turns on to indicate that a thick paper mode unique to the present invention has been set. At the same time, the paper tray 17 is raised such that the top paper (thick paper) 13 contacts the pick-up roller 18 with a preselected pressure.

The operator lays a desired document on the scanner and presses the perforation start key 91. In response, the master discharging operation is executed in the same manner as in the plain paper mode, and then the print drum 1 waits for a master 4. Subsequently, the image reading operation and master making operation are executed in the same manner as in the plain paper mode. The leading edge of the perforated part of the stencil 4, i.e., master is clamped by the master clamper 3. Thereafter, the master 4 is fully wrapped around the ink drum 1 as in the plain paper mode. The printer control unit 115 automatically drives the top-bottom drive motor 138 in response to the output pulse signal of the encoder 136. The rotation of the motor 138 is transmitted via the speed reduction gears 134 and 135 with the result that the plate member 133 and support arm 122 are angularly moved in the up-and-down direction in FIG. 21.

When the support arm 22 is angularly moved upward, as viewed in FIG. 21, the rotation transfer member 132 is rotated clockwise, as viewed in FIG. 21. However, the gears 128 and 130 are different from each other as to the number of teeth. In addition, the gear 130 does not rotate due to tension applied from the main motor 51 via the belt 78 which is passed over the pulley 77. As a result, only the gear portion 132*b* of the rotation transfer member 132 rolls on the gear 130. Therefore, the gear or planetary gear 128 meshing with the gear portion 132*a* integral with the gear portion 132*b* is caused to rotate clockwise, as viewed in FIG. 21, differentially in a deviated phase. Consequently, the press drum 8 is rotated in a direction indicated by an arrow g and has its phase advanced. Consequently, the image 36 is shifted to the upstream side on the paper 13 in the direction X.

As for the above top-bottom shift, the rotational movement of the speed reduction gear 135 and that of the press drum 8 to occur when the motor 138 is energized are measured beforehand and stored in the ROM of the printer control unit 115. When the thick paper mode is selected, the printer control unit 115 automatically determines the rotational movement of the speed reduction gear 135 and causes, based on the pulse signal output from the encoder 136, the motor 138 to operate for effecting a preselected top-bottom shift.

Subsequently, the paper (thick paper) 13 is fed in the manner described with reference to FIGS. 12 and 13. As the press drum 8 is further rotated counterclockwise, the screen plate 106 meets the photosensor 107 at the preselected timing and causes it to send an ON signal to the printer control unit 115. In response, the printer control unit 115 drives the stepping motor 102 at a timing different from the timing assigned to the plain paper mode. Consequently, the lower registration roller 16 is rotated counterclockwise, causing the loop 13A of the paper 13, FIG. 15, to disappear.

FIG. 17 demonstrates the paper feed and paper feed control particular to the thick paper mode. As shown, to prevent the leading edge portion of the thick paper 13 from being clamped by the paper clamper 14, the printer control unit 115 causes the stepping motor 102 to vary the timing at which the lower registration roller 16 drives the leading edge of the paper 13 toward the paper clamper 14. As a result, the leading edge of the paper 13 is shifted to the upstream side in the direction X with respect to the paper clamper 14. Stated another way, in response to the output signal of the photosensor 107, the printer control unit 115 so controls the stepping motor 102 as to delay the timing for the lower registration roller 16 to convey the leading edge of the paper 13 by a period of time corresponding to the unclamp length E, compared to the plain paper mode. This successfully prevents the paper clamper 14 from contacting the master 4 wrapped around the ink drum 1 and thereby solves the previously discussed problems.

The leading edge of the thick paper 13 is conveyed toward the paper clamper 14 with the pick-up roller 18 and reverse roller 19 being rotated by the paper 13 due to the function of their one-way clutches. However, the paper clamper 14 is closed without clamping the paper 13.

The press drum 8 is displaced upward toward the ink drum 1 due to the action of the springs 30*a* and 30*b* of the moving device 70, thereby forming the nip between the drums 8 and 1. The paper 13 conveyed to the above nip, but not clamped by the paper clamper 114, is pressed against the ink drum 1 by the press drum 8. As the paper 13 is continuously pressed against the master 4, the ink I is transferred from the porous portion 2*a* and screen layer 35 of the base 2 to the paper 13 via the perforated area of the master 4 in the same manner as in the plain paper mode.

More specifically, as shown in FIG. 17, the timing for the lower registration roller 16 to convey the leading edge of the paper 13 is delayed by a period of time corresponding to the unclamp length E, thereby shifting the position of the leading edge of the paper 13 with respect to the paper clamper 14. Therefore, despite that the paper 13 is thick, the end 14*a* of the paper clamper 14 is prevented from contacting the master 4 wrapped around the ink drum 1. Because the signal for so controlling the lower registration roller 16 is derived from the rotation of the press drum 8, the registration rollers 15 and 16 are capable of conveying the paper 13 at the above delayed timing accurately without any irregularity.

The master 4 is perforated over an area B while the image 36 is printed on the paper 13 over an area C coincident with the area B. The leading edge margin of the paper 13 has the same length A as in the plain paper mode, and the print ON timing is also the same as in the plain paper mode. The unclamp length E is selected to be about 5 mm to about 10 mm for the reason described in relation to the first embodiment.

As the press drum 8 is further rotated, the paper clamper 14 is opened at the paper discharge position short of the peeler 21. The peeler 21 peels off the paper or printing 13 from the press drum 8. As a result, the printing 13 is conveyed to the tray 23 by the conveyor belt 27. In this manner, trial printing for filling the perforations of the master 4 with the ink I is completed. At the same time, the ink drum 1 is released from the press drum 8 and restored to its initial position.

The operator checks the printing produced by the trial printing to see if the quality and position of the image are acceptable or not. If the printing is satisfactory, then the operator inputs a desired number of printings on the numeral keys 93 and then presses the print start key 92. As a result, the above procedure beginning with paper feed and ending with paper discharge is repeated a number of times corresponding to the desired number of printings.

Figure 18:
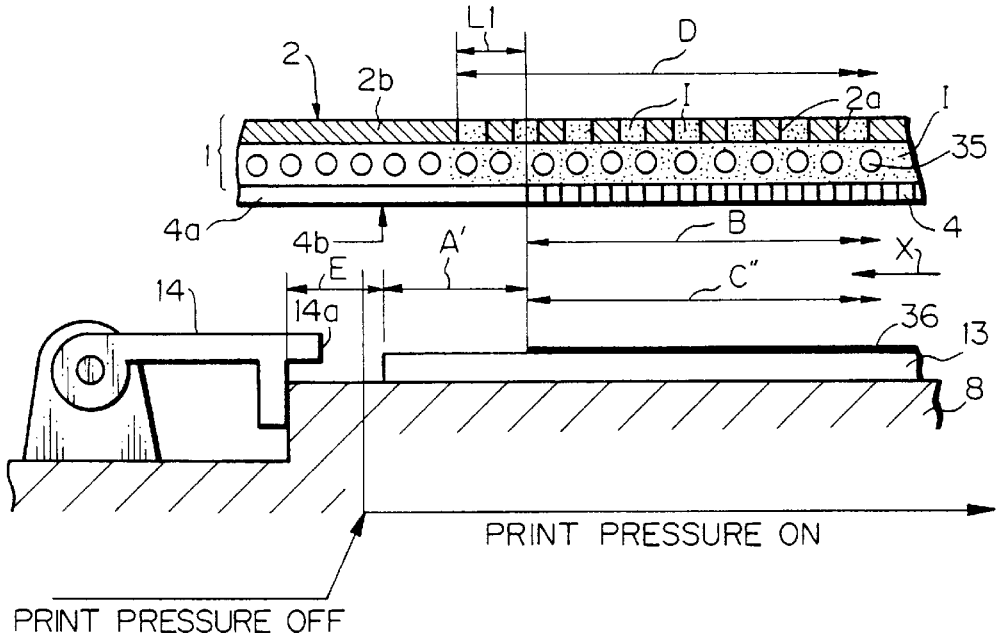
FIG. 18 is a view similar to FIG. 17, showing a positional relation occurring in the thick paper mode of the second embodiment when a top-bottom position is noticeably shifted to the upstream side in the direction of paper conveyance.

As shown in FIG. 18, assume that the top-bottom shifting device 80 is operated to provide the leading edge margin with a length A' greater than the length A. Then, even if the end 14*a* of the paper clamper 14*a* repeatedly hits against the same portion of the master 4 and causes the non-perforated area, labeled 4*b*, of the master 4 to rip, the ink I is prevented from leaking via the ripped portion of of the master 4. For example, in the condition shown in FIG. 6, the end 14*a* of the paper clamper 14 repeatedly hits against the non-perforated area 4*b* of the master 4 and causes it to rip. However, if the leading edge margin is provided with the length A' greater than the length A, as shown in FIG. 18, then the ink I is absent in the screen layer 35 and the non-porous area 2*b* of the base 2 at the rear of the non-perforated area 4*b* of the master 4. The ink I is therefore prevented from penetrating thorough the ripped portion of the master 4. In FIG. 18, labeled C" is the image area of the paper 13 particular to the illustrative embodiment.

This embodiment allows the operator to adjust the image position on the paper 13, as follows. Assume that the operator desires to shift the image 36 to the upstream side on the paper 13 in the direction of paper conveyance. Then, after the press drum 8 has been released from the print drum 1, the operator presses a top-bottom shift switch, not shown, provided on the operation panel 90. In response, the top-bottom drive motor 138 is energized. The rotation of the motor 138 is transferred to the plate member 133 and support arm 122 via the speed reduction gears 134 and 135, respectively. As a result, the plate member 133 and support arm 122 are angularly moved in the up-and-down direction, as viewed in FIG. 21.

When the support arm 122 is moved upward, as viewed in FIG. 21, the rotation transfer member 132 is rotated clockwise, as viewed in FIG. 21, by the above operation with the result that the image 36 is shifted to the upstream side on the paper 13 in the direction X. To shift the image 36 to the downstream side on the paper 13 in the direction X, the motor 138 should only be rotated to move the support arm 122 downward, as viewed in FIG. 21.

With the above configuration, the second embodiment also achieves the advantages (1)–(6) stated in relation to the first embodiment.

In the second embodiment, the printer control unit 115 varies the timing for the leading edge of the paper 13 to be fed toward the paper clamper 14. Alternatively, the printer control unit 115 may control the rotation speed of the stepping motor 102 so as to vary the peripheral speed of the registration rollers 15 and 16, as follows.

3rd Embodiment

A third embodiment of the present invention will be described with reference o FIGS. 7–9, 23 and 24. Assume that the leading edge of the paper 13 is simply shifted to the upstream side with respect to the paper clamper 14 to the upstream side in the direction X by a preselected amount. Then, the image 36 shown in FIG. 4 is shifted to the upstream side in the direction X with the result that the length A of the leading edge margin of the paper (thick paper) 13 is increased or the area of the image is reduced. Most preferably, therefore, there should be set up a condition wherein the leading edge of the paper 13 is not actually clamped by the paper clamper 14, but appears as if it were clamped by the same.

In the third embodiment, the speed at which the registration rollers 15 and 16 feeds the leading edge of the paper (thick paper) 13 (leading edge velocity v hereinafter) is so controlled as to prevent the leading edge of the paper 13 from reaching the paper clamper 14 before the paper clamper 14 closes after opening. Just after the paper clamper 14 has closed, the leading edge velocity v of the paper 13 is increased so as to cause the leading edge of the paper 13 to get on the top of the paper clamper 14 held in its closed position. When the print pressure is caused to act (ON), i.e., when the ink drum 1 and press drum 8 are brought into contact, the paper 13 appears as if it were clamped by the paper clamper 14 as in the plain paper mode.

In the third embodiment, too, the printer control unit 115 plays the role of control means for causing the leading edge of the paper (thick paper) 13 to be fed to a position where the leading edge will not be clamped by the paper clamper 14.

The third embodiment differs from the first embodiment in the following respect. In the first embodiment, when the paper 13 is a thick paper, the printer control unit 115 so controls the stepping motor 102 as to delay the paper feed timing in response to the output signal of the photosensor 107, and so controls the pulse motor 43 of the master make and feed driver 33 as to delay the perforation start position of the thermal head 41 accordingly. In the third embodiment, in the thick paper mode, just after the opening and closing motion of the paper clamper 14, the printer control unit 155 positions the leading edge of the paper (thick paper) 13 on the top of the paper clamper 14. More specifically, in the third embodiment, just after the opening and closing motion of the paper clamper 14, the printer control unit 155 controls, in response to the output signal of the photosensor 107, the stepping motor 102 in order to bring leading edge of the paper 13 to the top of the paper clamper 14.

Figure 23:
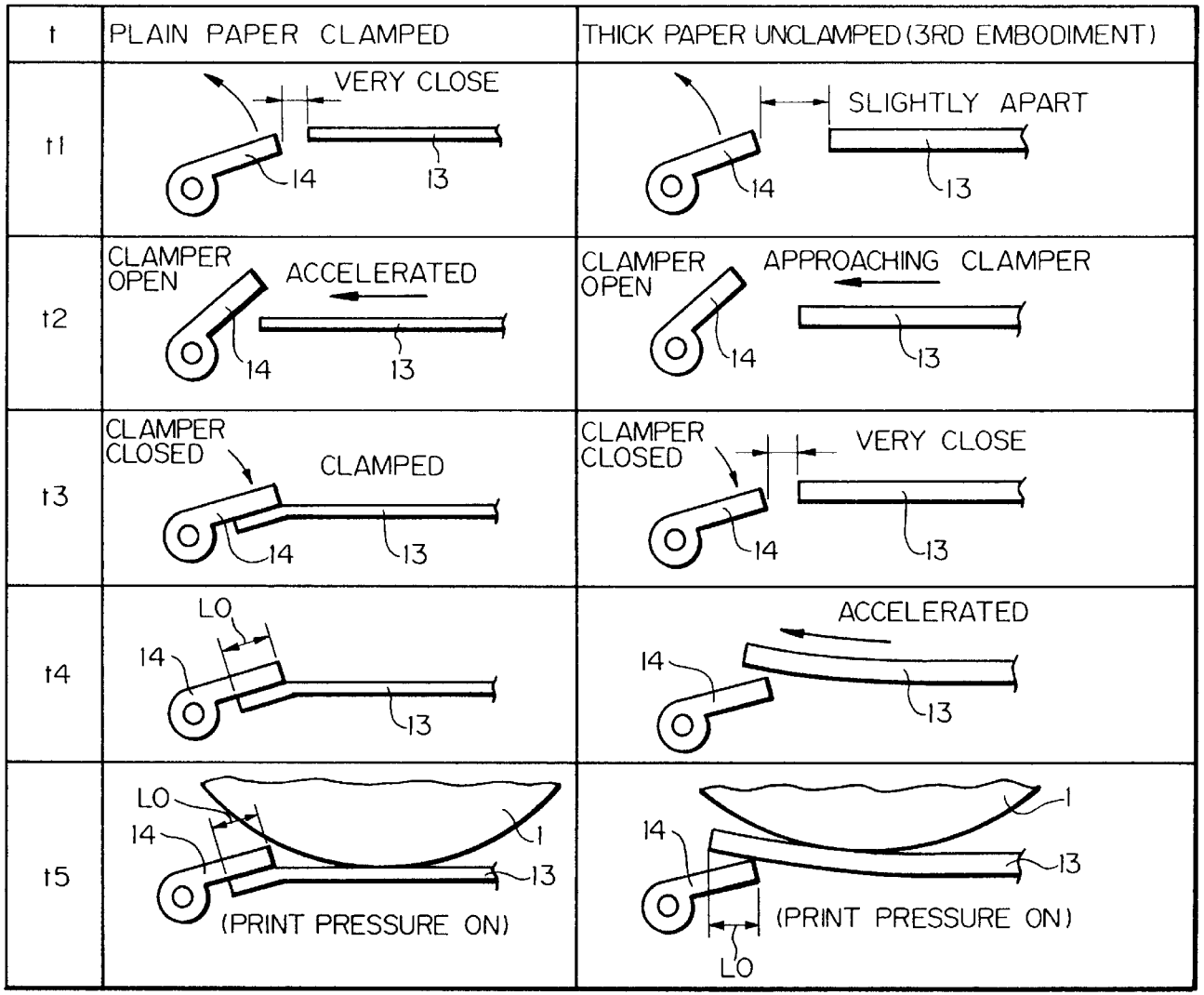
FIG. 23 shows a relation between the opening and closing of a paper clamper and the position of a paper effected in the thick paper mode in a third embodiment of the present invention, as well as the print ON/OFF of the press drum with respect to an ink drum.
Figure 24:
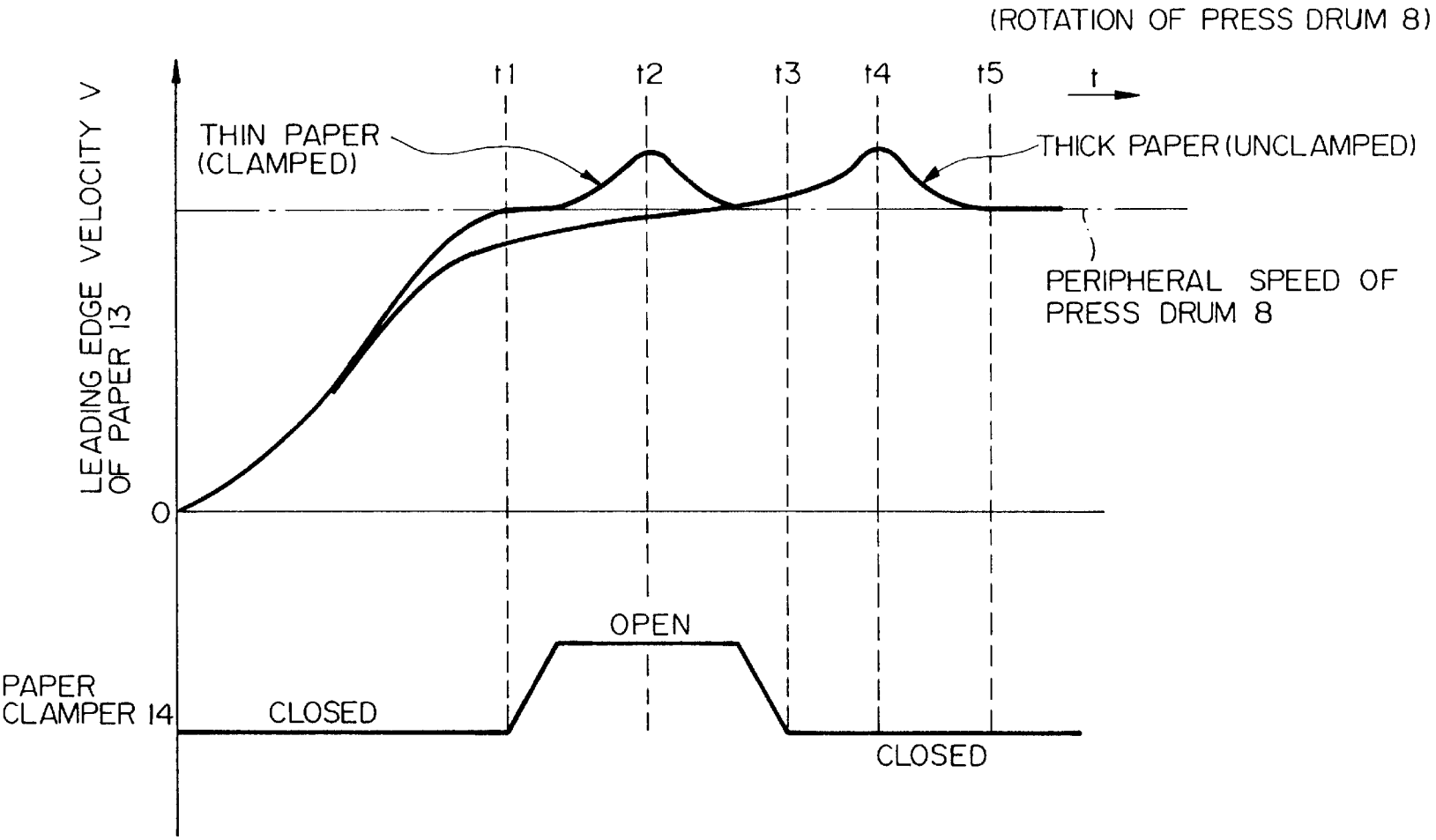
FIG. 24 is a timing chart representative of a paper feed control procedure particular to the thick paper mode of the third embodiment.

In the illustrative embodiment, the contents of control shown in FIG. 24 and determined by experiments and a program for so controlling the stepping motor 102 as to feed the leading edge of the paper (thick paper) in the manner shown in FIG. 23 are stored in the ROM of the printer control unit 115 beforehand. The RAM of the printer control unit 115 is used to temporarily store the results of arithmetic operations output from the CPU as well as the output signals of the photosensors 104 and 107 and the output signal of the paper sensor 85.

In the plain paper mode, the printer control unit 115 causes the same printing procedure as in the plain paper mode to be executed. In the thick paper mode, the printer control unit 115 urges the operator to input information indicative of the thick paper 13. Then, the printer control unit 115 controls the rotation speed of the stepping motor 102 and therefore the peripheral speed of the registration rollers 15 and 16. This prevents the leading edge of the thick paper 13 from being clamped by the paper clamper 14.

So long as the paper 13 is a thick paper, leaving the leading edge of the paper 13 unclamped does not matter at all for the reason stated in relation to the first embodiment. FIG. 23 shows in its right column a condition wherein the leading edge of the thick paper 13 is left unclamped by paper clamper 14 in accordance with the third embodiment. In FIG. 23, the left column shows a condition wherein the leading edge of the plain paper 13 is clamped by the paper clamper 14 in any one of the first to third embodiments for reference.

In FIG. 24, the ordinate indicates the leading edge velocity v of the paper 13 in its upper portion while the abscissa indicates times t1–t5 each corresponding to a particular rotation phase of the press drum 8. As for the leading edge velocity v, a thin solid line and a bold solid line are representatively representative of the case wherein the paper 13 is clamped and the case wherein it is not clamped. Further, a dash-and-dot line is representative of the peripheral speed of the press drum 8.

At the time t1 when the paper clamper 14 begins to open, the leading edge of the plain paper 13 to be clamped is about to reach the paper clamper 14 while the leading edge of the thick paper 13 not to be clamped may be positioned slightly apart from the paper clamper 14. Specifically, as for the thick paper 13 not to be clamped, the printer control unit 115 so controls the rotation speed of the stepping motor 102, i.e., the peripheral speed of the registration rollers 15 and 16 as to move the leading edge of the paper 13 at the velocity v at the time t1 shown in FIG. 24. In the following description, how the peripheral speed of the registration rollers 15 and 16 varies due to the control over the rotation speed of the stepping motor 102 will not be described for simplicity.

At the time t2 when the paper clamper 14 is open, the leading edge of the plain paper 13 is accelerated into the clamper 14. By contrast, the leading edge of the thick paper 13 not to be clamped does not reach the paper clamper 14 although it approaches the clamper 14. At the time t3 when the paper clamper 14 closes, the leading edge of the plain paper 13 is surely positioned in the clamper 14 and clamped thereby. By contrast, the leading edge of the thick paper 13 reaches a position just short of the paper clamper 14, but does not enter the clamper 14.

At the time t4 when the paper clamper 14 has just closed, the plain paper 13 is conveyed at a speed identical with the peripheral speed of the press drum 8 while having its leading edge portion clamped by the clamper 14 over a preselected length L0. On the other hand, the leading edge of the thick paper 13 is sharply accelerated and conveyed at a speed higher than the peripheral speed of the press drum 8. As a result, the leading edge of the thick paper 13 is brought to a position overlying the top of the closed paper clamper 14.

At the time t5 when the print pressure acts (ON), the plain paper 13 is pressed against the ink drum 1 by the press drum 8 via the master, not shown, with the leading edge thereof clamped by the paper clamper 14 over the length L0. On the other hand, the thick paper 13 is pressed against the master wrapped around the drum 1 with its leading edge portion overlying the paper clamper 14 over the length L0.

As stated above, the plain paper 13 is clamped by the paper clamper 14, but the thick paper 13 is not clamped by the same. However, the two kinds of papers 13 are held in the same relation to the master wrapped around the ink drum 1.

The third embodiment therefore also achieves the advantages (1)–(6) stated in relation to the first embodiment. In addition, in the third embodiment, the leading edge of the thick paper 13 is not clamped by the paper clamper 14, but is positioned as if it were clamped by the same. This eliminates the need for the control arrangement of the first or second embodiment for preventing the image on the thick paper 13 from being dislocated by the delay of the paper feed timing. It follows that the leading edge of the thick paper 13 can be fed in the optimal way.

4th Embodiment

Referring to FIGS. 7–9, 25 and 26, a fourth embodiment of the present invention will be described. In the first to third embodiments, in the plain paper mode, the paper clamper 14 opens and then closes in order to clamp leading edge of the paper 13. Even in the thick paper mode, the paper clamper 14 opens and then closes although not actually clamping the leading edge of the paper 13. In the thick paper mode, the paper clamper 14 may, of course, be continuously held in its closed position so as to allow the thick paper 13 to be fed as if it were fed in the plain paper mode, as follows.

In the fourth embodiment, in the thick paper mode, the paper clamper 14 is continuously held in its closed position. The paper feed and paper feed control are executed under the same conditions as in the plain paper mode, so that the leading edge of the thick paper 13 is caused to overly the paper clamper 14. When the print pressure acts (ON), i.e., when the press drum 8 is pressed against the ink drum 1, the thick paper 13 is positioned as if it were clamped by the paper clamper 14 in the plain paper mode.

The fourth embodiment mainly differs from the first embodiment in the following respects. The drive means 180 mentioned earlier is provided for actuating the paper clamper 14, i.e., selectively causing it to open and close or to remain in its closed position. The printer control unit 115 controls the solenoid 196, which will be described later, included in the drive means 180 in order to prevent the paper clamper 14 from clamping the leading edge of the thick paper 13. In the illustrative embodiment, the printer control unit 115 does not play the role of registration roller control means of the first embodiment, but controls the stepping motor 102 such that the leading edge of the thick paper 13 is fed at the time when the paper clamper 14 held in its closed position arrives at a position corresponding to the paper clamp position.

Figure 25:
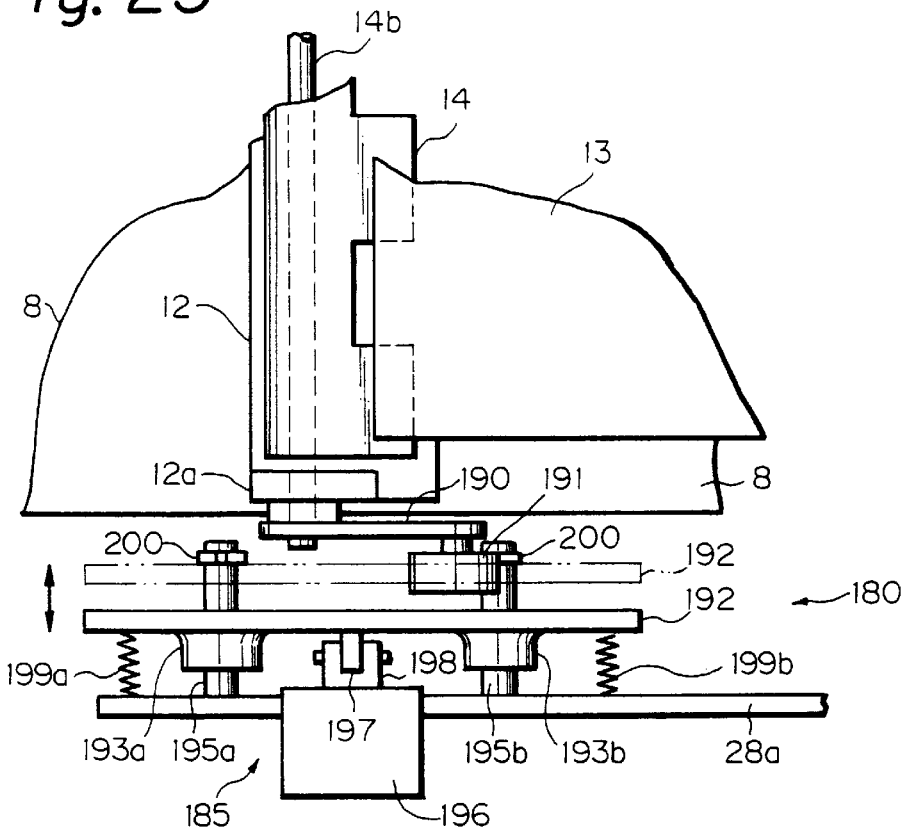
FIG. 25 is a plan view showing a fourth embodiment of the present invention in a condition implementing the thick paper mode.
Figure 26:
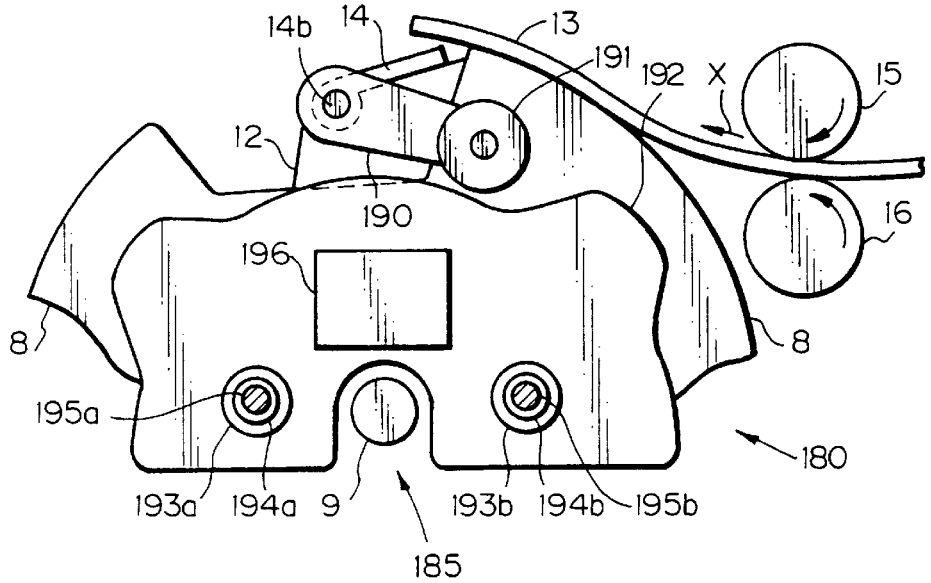
FIG. 26 is a fragmentary front view showing the fourth embodiment.

As shown in FIGS. 25 and 26, the drive means 180 includes a cam follower 191 mounted on the paper clamper 14 via an arm 190. A cam 192 is mounted on the printer body and engageable with the cam follower 191 at a preselected timing. Retracting means 185 causes the cam 192 to retract to a position indicated by a solid line in FIG. 25 where the cam 192 does not contact the cam follower 191, so that the paper clamper 14 is prevented from clamping the thick paper 13.

The clamper shaft 14*b* is rotatably supported by a shaft support portion 12*a* included in the clamper base 12. The arm 190 is substantially integrally affixed to one end of the clamper shaft 14*b*. The cam follower 191 is implemented by, e.g., a ball bearing and rotatably mounted on the free end of the arm 190. The top of the cam 192 is provided with a unique contour gently rising and falling, as illustrated. A pair of bosses 193*a* and 193*b* are formed integrally with the cam 192 at both sides of the shaft 9 of the press drum 8. Also, a lug 197 is formed integrally with the cam 192 above and between the bosses 193*a* and 193*b*. The cam 192 is movable between a contact position (dash-and-dots line) where it contacts the cam follower 191 and the previously mentioned retracted position (solid line), as will be described specifically later. When the press drum 8 and therefore the paper clamper 14 is brought to a preselected rotational position, the cam follower 191 contacts the contour of the cam 192 and causes the paper clamper 14 to open and close.

The retracting means 186 selectively moves the cam 192 to the contact position or the retracted position mentioned above. The retracting means 186 includes a pair of shafts 195*a* and 195*b* affixed to the arm 28*a*. The shafts 195*a* and 195*b* are respectively passed through the bosses 193*a* and 193*b* of the am 192 and allow the cam 192 to slide thereon toward the clamper shaft 14*b*. A pair of compression springs 199*a* and 199*b* are loaded between the arm 28*a* and the cam 192 at the outside of the shafts 195*a* and 195*b*, respectively, and constantly bias the cam 192 toward its contact position. The solenoid 196 is mounted on the arm 28*a* and plays the role of an actuator for moving the cam 192 to its retracted position. A stop ring 200 is fitted on the end of each shaft 195*a* or 195*b* for holding the cam 192 at the contact position. The solenoid 196 is implemented by a pull type DC solenoid and includes a plunger 198 connected to the lug 197 of the cam 192 by a pin.

The above retracting means 185 is only illustrative. If desired, the cam follower 191 and/or the arm 190 may be moved between the contact position and the retracted position relative to the cam 192 although such an alternative scheme would sophisticate the construction.

A program for controlling the stepping motor 102 and a program for controlling the solenoid 196 of the retracting means 185 are stored in the ROM of the printer control unit 115 beforehand.

In operation, when the paper 13 is a plain paper, the printer control unit 115 sets up a plain paper mode similar to the plain paper mode of the first to third embodiments and then executes printing. In this case, the operator presses the kind-of-paper key 94 once. In response, the lamp 95*a* on the operation panel 90 turns on, showing the operator that the plain paper mode has been set up. The printer control unit 115 outputs a command signal for deenergizing the solenoid 196. As a result, the cam 192 is held in its contact position due to the action of the compression springs 199*a* and 199*b*.

The procedure to follow is identical with the procedure occurring in the plain paper mode in any one of the first to third embodiments and will not be described in order to avoid redundancy.

When the paper 13 is a thick paper, leaving the leading edge portion of the paper 13 does not matter at all for the reason described in relation to the first embodiment. FIGS. 25 and 26 show a condition wherein the leading edge of the thick paper 13 is left unclamped by the paper clamper 14.

As for the thick paper mode, the operator confirms that thick papers are present on the paper tray 17, or stacks thick papers on the tray 17, and then presses the kind-of-paper key 94 twice. In response, the lamp 95*b* turns on. The printer control unit 115 sets up the thick paper mode and energizes the solenoid 196 of the retracting means via an electric circuit not shown. At the same time, the paper tray 17 is raised until the top thick paper 13 contacts the pick-up roller 18 with a preselected pressure.

The solenoid 196 energized by the printer control unit 115 pulls the plunger 198 against the action of the compression springs 199*a* and 199*b*. As a result, the cam 192 slides on the shafts 195*a* and 195*b* downward, as viewed in FIG. 25, to its retracted position. In this condition, the paper clamper 14 is held in its closed position by the springs. Subsequently, the operator sets a desired document on the scanner and then presses the perforation start key 91. This is followed by the master discharging operation, image reading operation and master making and feeding operation effected in the plain paper mode in the first embodiment.

After the above procedure, the same paper feed and paper feed control as in the plain paper mode of the first embodiment (except that the paper 13 is a thick paper) are executed. Specifically, just before the press drum 8 reaches the position shown in FIGS. 25 and 26, the leading edge of the thick paper 13 is caused to overly the closed paper clamper 14. When the print pressure acts (ON), i.e., when the press drum 8 is pressed against the ink drum 1, the paper 13 is positioned as if its leading edge portion were clamped by the paper clamper 14 in the plain paper mode. The procedure to follow is identical with the procedure occurring in the plain paper mode in the first to third embodiments and will not be described in order to avoid redundancy.

The fourth embodiment also achieves the same advantages (1)–(6) as the first embodiment. In addition, the retracting means 180 allows the paper clamper 14 to remain in its closed position. This, coupled with the fact that the leading edge of the thick paper 13 can be positioned as if it were clamped by the paper clamper 14, eliminates the need for the arrangement for preventing the image from being dislocated on the thick paper 13 by the delay of the paper feed timing.

Stated another way, in this embodiment, the drive means 180 can be implemented only if the arrangement around the press drum 8 is slightly modified. The paper clamper can be selectively caused to open and close or to stop doing so only if the drive means 180 moves the cam 192 along the clamper shaft 14*b*. It follows that both the wrapping of the paper 13 around the ink drum 1 and the ripping of the master 4 can be obviated in accordance with the kind of the paper 13 without the paper feed speed or the paper feed timing being varied.

In summary, it will be seen that the present invention provides a printer having various unprecedented advantages, as enumerated below.

(1) Even when an envelope or similar thick paper is used, the printer prevents the paper from wrapping around an ink drum and prevents a master wrapped around the ink drum from ripping in accordance with the kind of the paper without resorting to any modification of a basic arrangement around a press drum. Should the master tear, ink would smear printings.

(2) Clamping means does not clamp the leading edge of a particular kind of paper. In addition, the particular kind of paper can be positioned as if its leading edge were clamped by the clamping means. The leading edge of the particular kind of paper can therefore be fed in an optimal manner.

(3) Stable and reliable paper feed is enhanced.

(4) Stable and reliable paper feed timing is enhanced.

(5) An image is prevented from being dislocated on the paper by a delay of paper feed timing.

(6) Kind-of-paper setting means is capable of surely sensing the particular kind of paper or thick paper. This makes it needless for the operator to set the kind of paper each time.

(7) Control available with control means is manifold and can be freely changed by program software. Therefore, the freedom of change to optimal conditions is great.

(8) The clamping means can be selectively caused to open and close or to stop doing so only if drive means moves one of a cam and a cam follower to a position where it does not contact the other. It follows that the above advantage (1) is achievable without varying the paper feed speed or the paper feed timing.

Various modifications will become possible for those skilled in the art after receiving the teachings of the present disclosure without departing from the scope thereof. For example, the kind-of-paper key 94 may be replaced with any other suitable kind-of-paper setting means responsive to the kind of the paper 13. For example, the key 94 may be replaced with the paper sensor 85 shown in FIG. 9. The paper sensor 85 may be of the type optically sensing the thickness of the paper 13 in terms of the intensity of transmitted light or of the type mechanically sensing the thickness with an electric sensor by increasing a gap between rollers.

What is claimed is:

1. A printer including an ink drum for wrapping a master on an outer periphery thereof, and a press drum substantially identical in outside diameter with said ink drum and having clamping means for clamping a leading edge portion of a paper fed to said press drum, said press drum being pressed relatively against said ink drum for printing an image on said paper, said printer comprising:

a registration roller for feeding a leading edge of the paper toward said clamping means; and control means for causing, when the paper is a particular kind of paper, the leading edge of said paper to be fed to a position where said leading edge will not be clamped by said clamping means.

2. A printer as claimed in claim 1, wherein just after said clamping means has ended a clamping movement, said control means causes the particular kind of paper to be positioned on a top of said clamping means.

3. A printer as claimed in claim 2, further comprising:

registration roller drive means for causing said registration roller to rotate; and rotational position sensing means mounted on said press drum for sensing a rotational position of said clamping means;

said control means controlling, in response to an output signal of said rotational position sensing means, said registration roller drive means such that the leading edge of the particular kind of paper is positioned on the top of said clamping means just after the clamping movement of said clamping means.

4. A printer as claimed in claim 1, wherein said control means varies a timing for the leading edge of the particular kind of paper to be fed toward said clamping means such that said leading edge is shifted by a preselected amount to an upstream side in a direction of conveyance in which said particular kind of paper is conveyed.

5. A printer as claimed in claim 4, further comprising:

registration roller drive means for causing said registration roller to rotate; and rotational position sensing means mounted on said press drum for sensing a rotational position of said clamping means;

said control means controlling, in response to an output signal of said rotational position sensing means, said registration roller drive means such that the particular kind of paper is fed at a delayed timing, compared to an ordinary paper.

6. A printer as claimed in claim 5, further comprising:

master making mans for making the master; and master feeding means for feeding the master and wrapping said master around the outer periphery of said ink drum;

said control means controlling said master making means and said master feeding means such that a position of said master making means for starting making the master is delayed by an amount corresponding to a delay of feed of the particular kind of paper effected by said registration roller drive means.

7. A printer as claimed in claim 5, further comprising:

top-bottom adjusting means for adjusting a top-bottom position of an image on the paper in the direction of conveyance;

said control means controlling said top-bottom adjusting means such that a leading edge of the master is shifted to an upstream side in the direction of conveyance relative to the particular kind of paper by an amount corresponding to a delay of feed of said particular kind of paper effected by said registration roller drive means.

8. A printer as claimed in claim 1, further comprising kind-of-medium setting means for allowing an operator to input a kind of the paper, wherein the particular kind of paper is a relatively thick paper.

9. A printer as claimed in claim 1, further comprising kind-of-medium sensing means for sensing a kind of the paper, wherein the particular kind of paper to be sensed by said kind-of-medium sensing means is a relatively thick paper.

10. A printer as claimed in claim 1, wherein control effected by said control means for causing the leading edge of the particular kind of paper to be fed to said position includes varying a peripheral speed of said registration roller.

11. A printer including an ink drum for wrapping a master on an outer periphery thereof, and a press drum substantially identical in outside diameter with said ink drum and having clamping means for clamping a leading edge portion of a paper fed to said press drum, said press drum being pressed relatively against said ink drum for printing an image on said paper, said printer comprising:

drive means for causing said clamping means to operate;

a registration roller for feeding a leading edge of the paper toward said clamping means; and control means for controlling, when the paper is a particular kind of paper, said drive means such that said clamping means does not clamp the leading edge portion of said particular kind of paper.

12. A printer as claimed in claim 11, wherein said drive means comprises:

a cam follower included in said clamping means;

a cam engageable with said cam follower at a preselected timing; and retracting means for causing either one of said cam and said cam follower to retract to a position where said cam and said cam follower do not contact each other, for thereby preventing said clamping means from clamping the leading edge portion of the particular kind of paper.

* * * * *